US008870315B2

(12) United States Patent
Takahashi

(10) Patent No.: US 8,870,315 B2
(45) Date of Patent: Oct. 28, 2014

(54) IMAGE FORMING APPARATUS FEEDING INK IN COPING WITH CHANGE OF INK VISCOSITY AND CONTROL METHOD FOR SAME

(75) Inventor: So Takahashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 196 days.

(21) Appl. No.: 13/536,059

(22) Filed: Jun. 28, 2012

(65) Prior Publication Data

US 2013/0002741 A1 Jan. 3, 2013

(30) Foreign Application Priority Data

Jun. 30, 2011 (JP) ..... 2011-145299
Jun. 27, 2012 (JP) ..... 2012-144476

(51) Int. Cl.
*B41J 29/38* (2006.01)
*B41J 29/393* (2006.01)
*B41J 2/155* (2006.01)
*B41J 2/175* (2006.01)

(52) U.S. Cl.
CPC ..... *B41J 2/155* (2013.01); *B41J 2/17596* (2013.01); *B41J 2/175* (2013.01)
USPC ..... 347/6; 347/14; 347/19

(58) Field of Classification Search
CPC ..... B41J 2/175; B41J 2/17566; B41J 29/38
USPC ..... 347/6, 14, 19, 22, 29
See application file for complete search history.

(56) References Cited

U.S. PATENT DOCUMENTS 6,299,277 B1 10/2001 Fujii
2011/0074870 A1 3/2011 Maida

FOREIGN PATENT DOCUMENTS

JP 2005-059461 3/2005
JP 2010-046815 A 3/2010

*Primary Examiner* — Jannelle M Lebron
(74) *Attorney, Agent, or Firm* — McDonnell Boehnen Hulbert & Berghoff LLP

(57) ABSTRACT

An image forming apparatus may include a pump mechanism for feeding ink to a recording head, a time counting unit capable of measuring a stop time determined by calculating a duration of time for which the ink was stopped from being fed to the recording head, an ink temperature detection unit, a first liquid feed control unit and a second liquid feed control unit. The first liquid feed control unit may instruct the pump mechanism to execute a preliminary purge when the measured stop time is not shorter than a first time. The second liquid feed control unit may instruct the pump mechanism to execute a main purge. And the second liquid feed control unit may set a flow rate in the main purge based on both the measured stop time and the detected ink temperature.

10 Claims, 16 Drawing Sheets

511

| Time Zone | Preliminary Purge |
|---|---|
| 1st Time Zone (Not Shorter Than 1st Time) | Execution |
| 2nd or 3rd Time Zone (Shorter Than 1st Time) | Non-Execution |

1st Time Zone > 2nd Time Zone > 3rd Time Zone

1st Time Zone: Not Shorter Than 1st Time
2nd Time Zone: Not Shorter Than 2nd Time, But Shorter Than 1st Time
3rd Time Zone: Shorter Than 2nd Time 1st Time > 2nd Time

FIG. 6A

512

| Time Zone / Temperature Zone | 1st Temperature Zone | 2nd Temperature Zone | 3rd Temperature Zone |
|---|---|---|---|
| 1st Time Zone | 3rd Flow Rate | 3rd Flow Rate | 3rd Flow Rate |

1st Temperature Zone > 2nd Temperature Zone > 3rd Temperature Zone

1st Temperature Zone: Not Lower Than 1st Temperature
2nd Temperature Zone: Not Lower Than 2nd Temperature,
But Lower Than 1st Temperature
3rd Temperature Zone: Lower Than 2nd Temperature 1st Temperature > 2nd Temperature

FIG. 6B

513

| Time Zone / Temperature Zone | 1st Temperature Zone | 2nd Temperature Zone | 3rd Temperature Zone |
|---|---|---|---|
| 1st Time Zone | (3rd Flow Rate→) 1st Flow Rate | (3rd Flow Rate→) Not Lower Than 2nd Flow Rate, But Lower Than 1st Flow Rate | (3rd Flow Rate→) 2nd Flow Rate |
| 2nd Time Zone | 2nd Flow Rate | Not Lower Than 3rd Flow Rate, But Lower Than 2nd Flow Rate | 3rd Flow Rate |
| 3rd Time Zone | 1st Flow Rate | Not Lower Than 2nd Flow Rate, But Lower Than 1st Flow Rate | 2nd Flow Rate |

1st Flow Rate > 2nd Flow Rate > 3rd Flow Rate

FIG. 6C

514

| Flow Rate / Motor Driving Information | Motor Rotation Number (rpm) | Driving Time (s) | Flow Volume (ml) |
|---|---|---|---|
| 1st Flow Rate | A | a | x |
| 2nd Flow Rate | B | b | y |
| 3rd Flow Rate | C | c | Z |

A > B > C
a > b > c

FIG. 6D

516

| Environmental Historical Index | Motor Rotation Number (rpm) | Driving Time (s) | Flow Rate | Target Pressure |
|---|---|---|---|---|
| Not Less Than K1, But less Than K2 | D | d | 1st Flow Rate | P1 |
| Not Less Than K2, But less Than K3 | E | e | 2nd Flow Rate | P1 |
| Not Less Than K3 | F → E | f1 → f2 | 3rd Flow Rate → 2nd Flow Rate | P2 → P1 |

FIG. 9

| Evaporation Rate (kg/h) | | Humidity (%Rh) | | | | |
|---|---|---|---|---|---|---|
| | | 20 | 40 | 60 | 80 | 100 |
| Temperature (°C ) | 40 | 1.05 | 0.79 | 0.53 | 0.26 | 0.00 |
| | 30 | 0.60 | 0.45 | 0.30 | 0.15 | 0.00 |
| | 20 | 0.33 | 0.25 | 0.17 | 0.08 | 0.00 |
| | 10 | 0.17 | 0.13 | 0.09 | 0.04 | 0.00 |

FIG. 11

IMAGE FORMING APPARATUS FEEDING INK IN COPING WITH CHANGE OF INK VISCOSITY AND CONTROL METHOD FOR SAME

INCORPORATION BY REFERENCE

This application is based upon, and claims the benefit of priority from, corresponding Japanese Patent Applications No. 2011-145299 filed in the Japan Patent Office on Jun. 30, 2011 and No. 2012-144476 filed on Jun. 27, 2012, the contents of which are fully incorporated herein by reference.

BACKGROUND

This disclosure relates to an image forming apparatus in which ink is jetted from a head nozzle to record an image on a recording medium, such as a sheet of paper.

An image forming apparatus may take various forms. In one example embodiment, the image forming apparatus takes the form of an inkjet recording apparatus, and includes a head having a plurality of ink-jetting nozzles from which ink is jetted. The ink is supplied to the head from an ink tank.

The inkjet recording apparatus generally includes a pump mechanism disposed in an ink supply path through which the ink is supplied to the head from the ink tank.

In some instances, an ejection state of the pump mechanism may become irregular (i.e., the ink may not eject properly) due to, for example, aggregates contained in the ink, or dust adhering to a surface of the nozzle. In such circumstances, streak-like blanks (i.e., white streaks) may appear in an image as it is recorded.

On these occasions, the inkjet recording apparatus performs a purge operation by jetting a large amount of ink from the ink-jetting nozzle to clean the inside of the nozzle so that the ink ejection state is returned to a normal state. The purge operation is performed by supplying a large amount of ink to the head of the inkjet recording apparatus from the ink tank with the pump mechanism.

However, ink viscosity may vary during the purge operation, causing the purge operation to damage the pump mechanism, or even to fail. The ink viscosity variations may occur as a result of temperature variations. For example, when ink is at low temperature, the ink viscosity becomes higher. Accordingly, when ink having a low temperature is supplied from the ink tank to the head by the pump mechanism, ink pressure may excessively rise in an attempt to ensure the ink makes it to the head.

In such a situation, however, members constituting ink flow paths and/or members constituting the pump mechanism may be damaged due to the excessively raised pressure.

Conversely, when ink temperature is high, the ink pressure becomes lower. Under these circumstances, a desired cleaning effect may not be obtained due to the lack of pressure.

In view of the above-mentioned problem, an inkjet recording apparatus is proposed as one type of image forming apparatus. The inkjet recording apparatus includes a temperature detection portion to detect a temperature, and an operation changing portion to change an operation of a pressurization pump of the inkjet recording apparatus in accordance with a detection result of the temperature detection portion.

SUMMARY

In an example embodiment according to this disclosure, an image forming apparatus is disclosed. The image forming apparatus may include an ink tank configured to contain ink, a head unit having a nozzle configured to eject the ink, a liquid feed path configured to feed the ink contained in the ink tank to the head unit, a liquid feed status detection unit, a time counting unit, a temperature detection unit, a first liquid feed control unit, and a second liquid feed control unit. The liquid feed unit is configured to feed the ink contained in the ink tank to the head unit through the liquid feed path, the liquid feed unit being configured to be capable of executing a main purge of feeding the ink to the head unit at a predetermined flow rate, and a preliminary purge, executed prior to the main purge, of feeding the ink to the head unit at a flow rate not higher than the predetermined flow rate. The liquid feed status detection unit is configured to be capable of detecting a status of the ink feed to the head unit. The time counting unit is configured to be capable of measuring, based on a detection result in the liquid feed status detection unit, a stop time. The stop time may be determined by calculating a duration of time for which the ink was stopped from being fed to the head unit. The ink temperature detection unit is configured to detect an ink temperature of the ink supplied to the head unit. The first liquid feed control unit is configured to instruct the liquid feed unit to execute the preliminary purge. The first liquid feed control unit is also configured to instruct the liquid feed unit to execute the preliminary purge when a stop time given as the time measured by the time counting unit is not shorter than a first time, and instruct the liquid feed unit not to execute the preliminary purge when the stop time is shorter than the first time. The second liquid feed control unit is configured to instruct the liquid feed unit to execute the main purge. The second liquid feed control unit is also configured to set the predetermined flow rate based on both the stop time measured by the time counting unit and the ink temperature detected by the ink temperature detection unit.

In another example embodiment according to this disclosure, an image forming apparatus may include an ink tank configured to contain ink, a head unit having a nozzle configured to eject the ink, a liquid feed path configured to feed the ink contained in the ink tank to the head unit, a liquid feed unit, a liquid feed status detection unit, a time counting unit, an environmental temperature detection unit configured to detect an environmental temperature, an environmental humidity detection unit configured to detect an environmental humidity, an environment historical index calculation unit, and a liquid feed control unit. The liquid feed unit is configured to feed the ink contained in the ink tank to the head unit through the liquid feed path. The liquid feed status detection unit is configured to detect a status of the ink feed to the head unit. The time counting unit is configured to measure, based on a detection result in the liquid feed status detection unit, a stop time. The stop time may be determined by calculating a duration of time for which the ink was stopped from being fed to the head unit. The environmental historical index calculation unit is configured to calculate an environmental historical index based on at least one of (1) an environmental temperature value that is a value of the environmental temperature detected by the environmental temperature detection unit and (2) an environmental humidity value that is a value of the environmental humidity detected by the environmental humidity detection unit, and on a stop time value that is a value of the stop time measured by the time counting unit. The liquid feed control unit is configured to control the liquid feed unit in accordance with the environmental historical index calculated by the environmental historical index calculation unit.

In yet another embodiment according to this disclosure, a control method for an image forming apparatus is disclosed. The method may include (i) detecting a liquid feed status corresponding to ink fed to the head unit, (ii) measuring, based on a detection result of the liquid feed status, a stop time lapsed from stopping of the ink feed to the head unit, (iii) detecting a temperature of the ink fed to the head unit, (iv) setting a predetermined flow rate based on both the measured stop time and the detected ink temperature, and (v) executing a main purge of feeding the ink to the head unit at the predetermined flow rate. The stop time may be determined by calculating a duration of time for which the ink was stopped from being fed to the head unit These as well as other aspects, advantages, and alternatives will become apparent to those of ordinary skill in the art by reading the following detailed description with reference, where appropriate, to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 6A illustrates a preliminary purge execution/non-execution management table stored in a memory (liquid-feed control information storage).

FIG. 6B illustrates a preliminary purge flow rate management table stored in the memory (liquid-feed control information storage).

FIG. 6C illustrates a main purge flow rate management table stored in the memory (liquid-feed control information storage).

FIG. 6D illustrates a motor-driving information management table stored in the memory (liquid-feed control information storage).

FIG. 9 illustrates a motor-driving information management table stored in the memory (liquid-feed control information storage).

FIG. 11 is a table representing the relationship of temperature and humidity versus evaporation rate.

DETAILED DESCRIPTION

Figure 1:
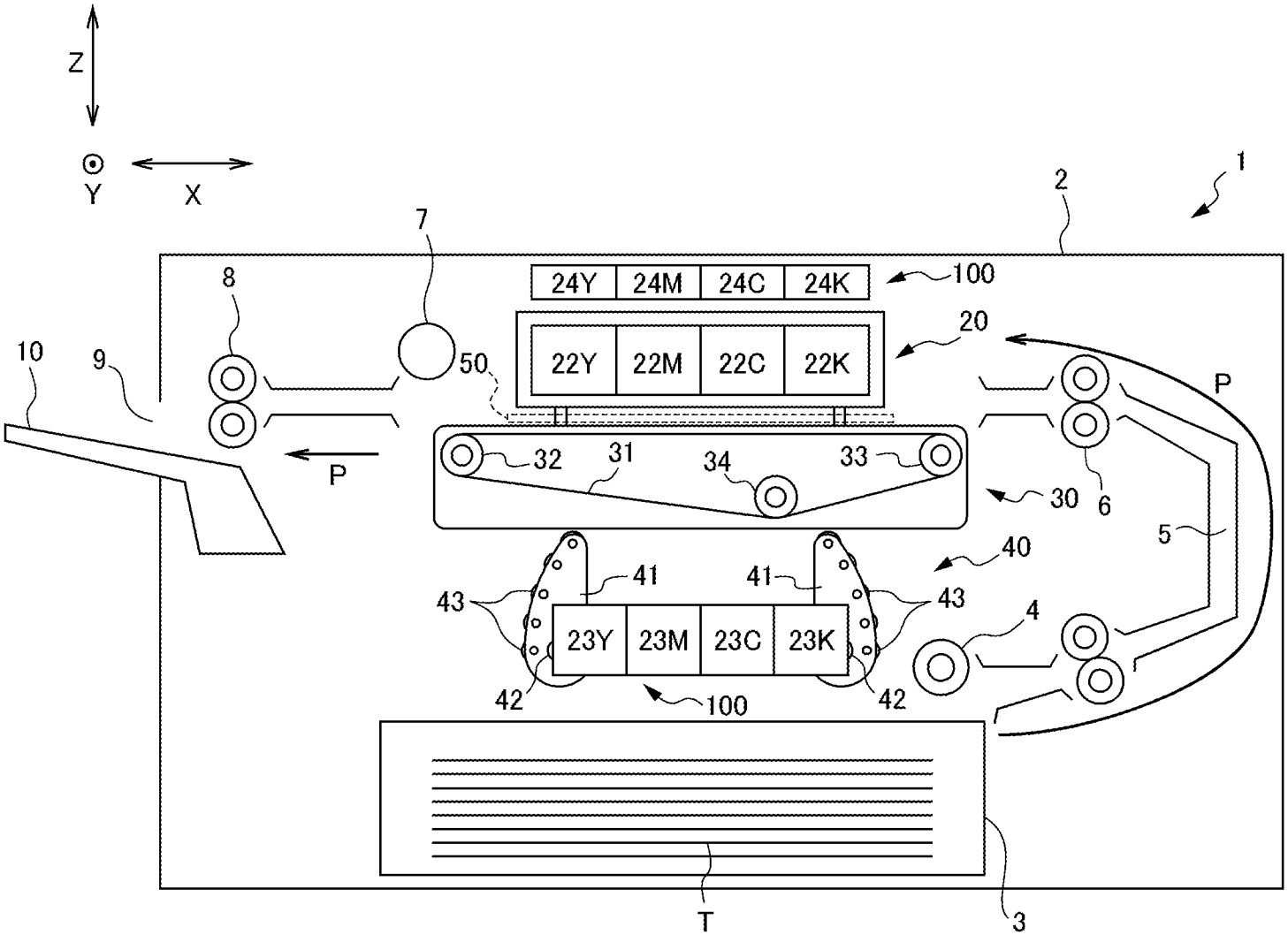
FIG. 1 is a schematic view taken along a vertical axis illustrating an inkjet recording apparatus according to a first embodiment when viewed from the front side.

Examples of an apparatus and method for coping with changing ink viscosity during ink feeding are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are contemplated herein.

An example first embodiment of this disclosure will now be described below with reference to FIGS. 1 and 2.

FIG. 1 is a schematic view taken along a vertical axis illustrating an inkjet recording apparatus 1, when viewed from the front side. FIG. 2 illustrates a top view of a recording unit 20 (shown in FIG. 1), a conveying unit 30, and surroundings thereof within the inkjet recording apparatus 1 according to the first embodiment. In FIG. 1, the inkjet recording apparatus 1 illustrates an example embodiment where a cap unit 50 may be attached to recording heads 22.

Figure 2:
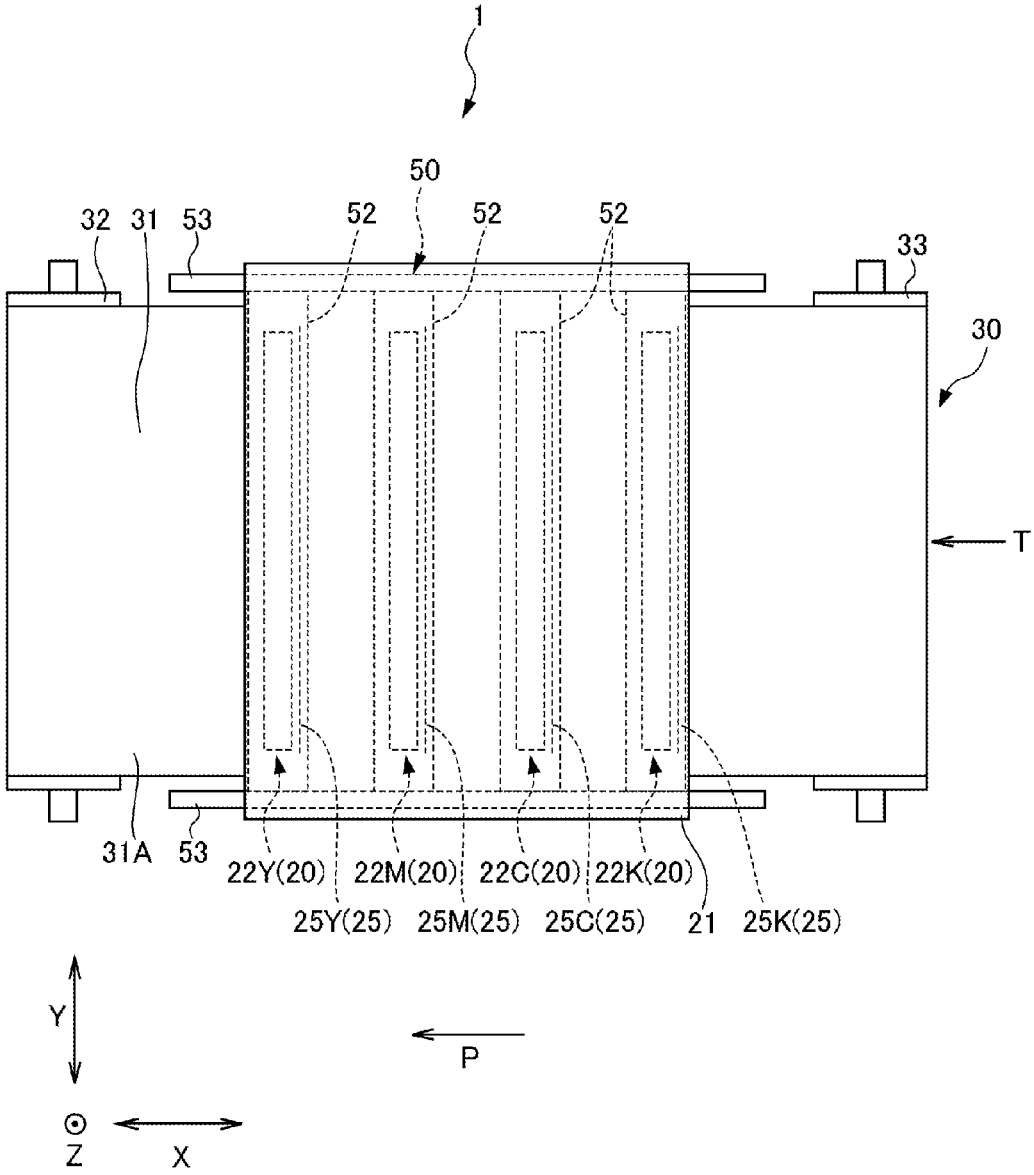
FIG. 2 is a plan view illustrating a recording unit, a conveying unit, and surroundings thereof in the inkjet recording apparatus according to the first embodiment in a state where a cap unit is attached corresponding to recording heads.

According to the first embodiment, as illustrated in FIGS. 1 and 2, the inkjet recording apparatus 1 includes a main body 2, the recording unit 20, a cleaning unit 25, the conveying unit 30, an ink supply unit 100, and an elevating device 40. The elevating device 40 may be used to raise and lower the conveying unit 30, for example. The inkjet recording apparatus also includes the cap unit 50, a first horizontal moving mechanism (not illustrated), and a second horizontal moving mechanism (not illustrated). The first horizontal moving mechanism and the second horizontal moving mechanism may be used to horizontally move the cap unit 50 and the cleaning unit 25, respectively. The inkjet recording apparatus 1 further includes a paper feed cassette 3, a paper feed roller 4, a paper conveying path 5, a registration roller pair 6, a drying device 7, a paper discharge roller pair 8, a paper discharge opening 9, and a paper discharge tray 10.

As illustrated in FIGS. 1 and 2, the conveying unit 30 includes a drive roller 32, a driven roller 33, a conveyor belt 31 that runs around the drive roller 32 and the driven roller 33, a tension roller 34 to adjust tension of the conveyor belt 31, and an air suction unit (not illustrated) disposed under a conveying surface 31A of the conveyor belt 31 (i.e., on the side opposite the recording unit 20). Many through-holes (not illustrated) for air suction are formed through the conveyor belt 31 and in an upper surface of the air suction unit.

When the drive roller 32 and the driven roller 33 are rotated counterclockwise, the conveying surface 31A, provided by an upper surface of the conveyor belt 31, may be moved in a horizontal motion from one side of the conveying unit 30 to the other side of the conveying unit 30 in a horizontal plane (X-Y plane) along a paper feed direction P. In other words, the paper feed direction P is substantially aligned with a horizontal direction X on the conveying surface 31A of the conveyor belt 31. The air suction unit may be disposed under the conveying surface 31A of the conveyor belt 31 (i.e., on the side opposite of the recording unit 20), and generates a suction force to suck a sheet of paper T (also simply called a sheet T), as a recording medium, to the conveying surface 31A of the conveyor belt 31.

The conveyor belt 31 may be an endless belt that is formed, for example, by overlapping opposite ends of a belt and joining them together, or a seamless belt having no seams.

In a predetermined recording mode, as illustrated in FIG. 2, the sheet T (e.g., paper), used as the recording medium, is introduced from one side of the inkjet recording apparatus 1, in the paper feed direction P, onto the conveying surface 31A of the conveyor belt 31. With the operation of the air suction unit (not illustrated), the suction force acting on the conveyor belt 31 is generated in the conveying surface 31A via the above-mentioned through-holes (not illustrated) for air suction. The sheet T, having been introduced onto the conveying surface 31A of the conveyor belt 31, may be drawn to the conveying surface 31A as a result of the air suction force, and may be conveyed toward the other side of the inkjet recording apparatus in the paper feed direction P. Characters, text, an image, etc. are recorded (i.e., printed) on the sheet T with inks ejected from recording heads 22 of the recording unit 20, described later, to the sheet T under conveyance in a state where the sheet T is drawn to the conveying surface 31A of the conveyor belt 31.

As illustrated in FIG. 1, the paper feed cassette 3 may accommodate multiple sheets T in a stacked state, and may be disposed in a lower region within the main body 2 of the inkjet recording apparatus 1. The paper feed cassette may rest on the upstream side of the conveying unit 30 in the paper feed direction P. The paper feed roller 4 may be disposed above the paper feed cassette 3. The sheet T may exit the paper feed cassette 3 via the paper feed roller 4, and may move toward the upper right as viewed in FIG. 1.

The paper conveying path 5, the registration roller pair 6, the recording unit 20, and the conveying unit 30 are disposed on the downstream side of the paper feed cassette 3 in the paper feed direction P. The sheet T let out from the paper feed cassette 3 reaches the registration roller pair 6 through the paper conveying path 5. The registration roller pair 6 may correct any skewed feed of the sheet T, and may also feed the sheet T. A leading end of the sheet T may be detected, for example, by a sheet end detection sensor (not illustrated) that is disposed in the paper conveying path 5 between the recording unit 20 and the registration roller pair 6. In accordance with the timing at which the leading end of the sheet T is detected, the recording unit 20 may execute an ink ejecting operation, which is described in detail later.

As illustrated in FIG. 1, the drying device 7 is disposed in an upper region within the main body 2 of the inkjet recording apparatus 1, on the downstream side of the conveying unit 30 in the paper feed direction P. The drying device 7 dries the ink on the sheet T after the recording has been made with the ejected ink in the recording unit 20.

The paper discharge roller pair 8, the paper discharge opening 9, and the paper discharge tray 10 are disposed in this order on the downstream side of the drying device 7 in the paper feed direction P. The sheet T on which the ink has been completely dried by the drying device 7 is fed toward the downstream side in the paper feed direction P by the paper discharge roller pair 8. Further, the sheet T is fed toward the paper discharge tray 10, which is disposed outside the main body 2, through the paper discharge opening 9, and is discharged outside the main body 2.

As illustrated in FIGS. 1 and 2, the recording unit 20 includes the recording heads 22, which correspond to four colors. The recording heads 22 may include a black recording head 22K, a cyan recording head 22C, a magenta recording head 22M, and a yellow recording head 22Y. Each of the four color-recording heads 22K, 22C, 22M and 22Y may have an elongated shape extending in a sheet width direction Y (i.e., the vertical direction Y) that is perpendicular to the paper feed direction P (i.e., the horizontal direction X). The recording heads 22K, 22C, 22M and 22Y may be successively disposed in this order side by side along the conveyor belt 31, in the paper feed direction P.

The four color-recording heads 22K, 22C, 22M and 22Y may each have nozzle surfaces 221 (see FIG. 3) on which an ink-jetting nozzle may be formed. The nozzle surfaces 221 define respective lower surfaces of the four color-recording heads 22K, 22C, 22M and 22Y. The nozzle surfaces 221 of the recording heads 22K, 22C, 22M and 22Y are positioned to face the conveying surface 31A of the conveyor belt 31. The four color-recording heads 22K, 22C, 22M and 22Y may be configured to record an image on the sheet T with the inks jetted from the ink-jetting nozzles that are formed in their nozzle surfaces 221.

As illustrated in FIG. 1, the ink supply unit 100 includes four ink tanks 23K, 23C, 23M and 23Y, and four pump mechanisms 24K, 24C, 24M and 24Y.

The four ink tanks 23K, 23C, 23M and 23Y are disposed under the conveying unit 30 corresponding respectively to the four color-recording heads 22K, 22C, 22M and 22Y. The four ink tanks 23K, 23C, 23M and 23Y contain respective inks that are supplied to the four recording heads: 22K, 22C, 22M and 22Y. The four colors of ink contained in the four ink tanks 23K, 23C, 23M and 23Y may be supplied respectively to the four pump mechanisms 24K, 24C, 24M and 24Y, which are described in detail later. The four ink tanks 23K, 23C, 23M and 23Y may be successively disposed in this order side by side along the conveyor belt 31 in the paper feed direction P from the upstream side toward the downstream side in the paper feed direction P.

The four pump mechanisms 24K, 24C, 24M and 24Y may be disposed above the conveying unit 30 and the four recording heads 22K, 22C, 22M and 22Y, corresponding to the four ink tanks 23K, 23C, 23M and 23Y, respectively. The four pump mechanisms 24K, 24C, 24M and 24Y may be successively disposed in this order side by side along the conveyor belt 31 in the paper feed direction P.

The four pump mechanisms 24K, 24C, 24M and 24Y temporarily store ink including the four different colors, which are contained in the four ink tanks 23K, 23C, 23M and 23Y, respectively. The different color ink, contained in the four pump mechanisms 24K, 24C, 24M and 24Y, are supplied from the four pump mechanisms 24K, 24C, 24M and 24Y to the four color-recording heads 22K, 22C, 22M and 22Y, respectively.

Details of the ink supply unit 100 are described in detail later in this disclosure.

It is to be noted that, in the following description, the recording heads 22K, 22C, 22M and 22Y corresponding to the four colors, the four ink tanks 23K, 23C, 23M and 23Y, and the four pump mechanisms 24K, 24C, 24M and 24Y are simply denoted by the "recording heads 22", the "ink tanks 23", and the "pump mechanisms 24" with omission of color identification symbols "K", "C", "M" and "Y", respectively, except for the case where the colors need to be particularly specified.

The recording heads 22 in the recording unit 20 may eject ink toward the sheet T, which is positioned on the conveying surface 31A of the conveyor belt 31, in accordance with image data information (e.g., data information of characters, figures and patterns) received from an external computer (not illustrated). As illustrated in FIG. 2, the recording heads 22 are supported by a recording head support member 21 having a rectangular shape and are fixed to the main body 2 with the recording head support member 21. Furthermore, while circulating (i.e., moving) the conveyor belt 31, the different inks may be successively ejected from the recording heads 22 at predetermined times. Thus, the different color inks—black, cyan, magenta and yellow—may be superimposed over each other, thereby causing a color ink image to be printed on the sheet T.

The different inks may be ejected from the recording heads 22 by using a range of suitable ejection techniques, such as the piezoelectric technique or a thermal inkjet technique, for example. The piezoelectric technique ejects ink by using a piezoelectric device (not illustrated) and applying pressure to the ink through the piezoelectric device, thereby pushing out the ink. The thermal inkjet technique generates bubbles using a heating member (not illustrated) and applies pressure to ink with the bubbles, thereby ejecting the ink.

As illustrated in FIG. 1, the elevating device 40, which may be disposed under the conveying unit 30, may be used to raise and lower the conveying unit 30. The elevating device 40 may raise and lower the conveying unit 30 in a Z direction (hereinafter referred to as a "vertical direction Z") perpendicular to the horizontal plane (X-Y plane) with respect to the recording heads 22. With the movement of the conveying unit 30 in the vertical direction Z by the elevating device 40, the conveying surface 31A of the conveyor belt 31 may be moved closer to or farther away from the nozzle surface 221 (see FIG. 3) of each of the recording heads 22.

As illustrated in FIG. 1, the elevating device 40 may also include four eccentric cams 41 that are disposed under the conveyor belt 31 (two on the upstream side and two on the downstream side) in the paper feed direction P. An eccentric peripheral surface of each of the eccentric cams 41 may be moved closer to an outer bottom surface of the conveying unit 30 from below. As illustrated in FIG. 1, each eccentric cam 41 may include a shaft 42, which extends in the sheet width direction Y, and a rotational axis, which is eccentrically positioned. The eccentric cam 41 may be rotated about the shaft 42 by a motor (not illustrated), for example. The eccentric cam 41 includes a plurality of bearings 43 that may be positioned along a peripheral edge thereof. Peripheral surfaces of the bearings 43 may partly project outward from the peripheral surface of the eccentric cams 41.

The bearings 43 are each rotatable about an axis that is parallel to the rotational axis of the eccentric cam 41. The bearings 43 may be successively arranged at intervals from the side close to a distal end of the eccentric cam 41 toward the side close to the rotation axis. In an ordinary printing state, as illustrated in FIG. 1, the bearings 43 farthest away from the shaft 42 are contacted against the outer bottom surface of the conveying unit 30 from below. At that time, the conveying unit 30 may be maximally raised to a top position.

From the above-mentioned state, the eccentric cam 41 on the upstream side in the paper feed direction P may be rotated counterclockwise when viewed from the front side, and the eccentric cam 41 on the downstream side in the paper feed direction P may be rotated clockwise when viewed from the front side. As a result, the bearings 43 are successively brought into contact against the outer bottom surface of the conveying unit 30 starting with the bearing 43 that is positioned farthest away from the shaft 42, to the bearing 43 that is positioned closest to the shaft 42. Using this rotational method, the conveying unit 30 may be gradually lowered.

The bearings 43 may be positioned such that, when the eccentric cams 41 are rotated, two of the bearings 43 that are opposite each other along each of the peripheral edges of the eccentric cams 41, make contact with the outer bottom surface of the conveying unit 30 at the same time.

When the conveying unit 30 is lowered with the rotation of the eccentric cams 41 of the elevating device 40, the conveying surface 31A of the conveyor belt 31 in the conveying unit 30 may be moved downward away from the recording heads 22.

As illustrated in FIG. 1, the cap unit 50 is configured such that it may be positioned under the recording unit 20 and above the conveying unit 30 (i.e., between the recording unit 20 and the conveying unit 30). As illustrated in FIG. 2, the cap unit 50 includes a plurality of cap cases 52 that correspond to the recording heads 22, respectively, and a cap base member 53 that supports the cap cases 52 in a predetermined positional relationship.

The cap unit 50 may be raised and lowered in conjunction with the rising and lowering of the conveying unit 30 by the elevating device 40 in a state where the cap unit 50 is positioned between the recording unit 20 and the conveying unit 30. Thus, when the conveying unit 30 is lowered in accordance with the rotation of the eccentric cams 41 of the elevating device 40, the cap unit 50 may be moved downwards away from the recording heads 22 in conjunction with the lowering of the conveying surface 31A of the conveyor belt 31.

As a result, the cap unit 50 is positioned apart from the recording heads 22. An ejection recovery process, i.e., a purge (or purging), may be executed to cause high-viscosity ink, which may, at times, remain in each nozzle, to be ejected from the ink-jetting nozzles. For example, by jetting the different inks from the ink-jetting nozzles (not illustrated) in the nozzle surfaces 221 of the recording heads 22 in the state where the cap unit 50 is positioned apart from the recording heads 22, the clogging can be released.

Conversely, when the conveying unit 30 is raised by rotating the eccentric cams 41 of the elevating device 40 in directions opposite those in the above-referenced case, the conveying unit 30 is returned to the ordinary recording position (i.e., the printing position).

Here, it is to be noted that, in the state where the cap unit 50 is positioned between the recording unit 20 and the conveying unit 30, the cap unit 50 may be attached to the nozzle surfaces 221 (see FIG. 3) of the recording heads 22. Also, when the cap unit 50 is moved by the later-described first horizontal moving mechanism (not illustrated), and is in a state not positioned between the recording unit 20 and the conveying unit 30, the recording heads 22 may eject the different inks toward the sheet T that is positioned on the conveying surface 31A of the conveyor belt 31.

The cap unit 50 may be horizontally movable in the paper feed direction P (see FIG. 1) when the cap base member 53 is horizontally moved by the first horizontal moving mechanism (not illustrated), for example.

With the operation of the first horizontal moving mechanism, the cap unit 50 may be selectively moved to an attachment/detachment position where the cap cases 52 may be detached or attached to the recording heads 22, or to a retracted position that is horizontally spaced from the attachment/detachment position. The cap unit 50 is held in the retracted position when the recording unit 20 is under the recording operation.

The cleaning unit 25 may be configured such that it may be positioned under the cap unit 50 and above the conveying unit 30 (i.e., between the cap unit 50 and the conveying unit 30). As with the cap unit 50, the cleaning unit 25 may be raised and lowered in conjunction with the raising and lowering of the conveying unit 30 by the elevating device 40, for example, in a state where the cleaning unit 25 is positioned between the cap unit 50 and the conveying unit 30.

Further, the cleaning unit 25 may be horizontally movable in the paper feed direction P (see FIG. 1) by a second horizontal moving mechanism (not illustrated). With the operation of the second horizontal moving mechanism, the cleaning unit 25 is selectively moved to a wiping position where the cleaning unit 25 is located under the recording heads 22 to clean the recording heads 22, or to a retracted position that is horizontally spaced from the wiping position. The cleaning unit 25 may be held in the retracted position when the recording unit 20 is in the recording operation and when the cap unit 50 is attached to the nozzle surfaces 221 (see FIG. 3) of the recording heads 22.

Figure 3:
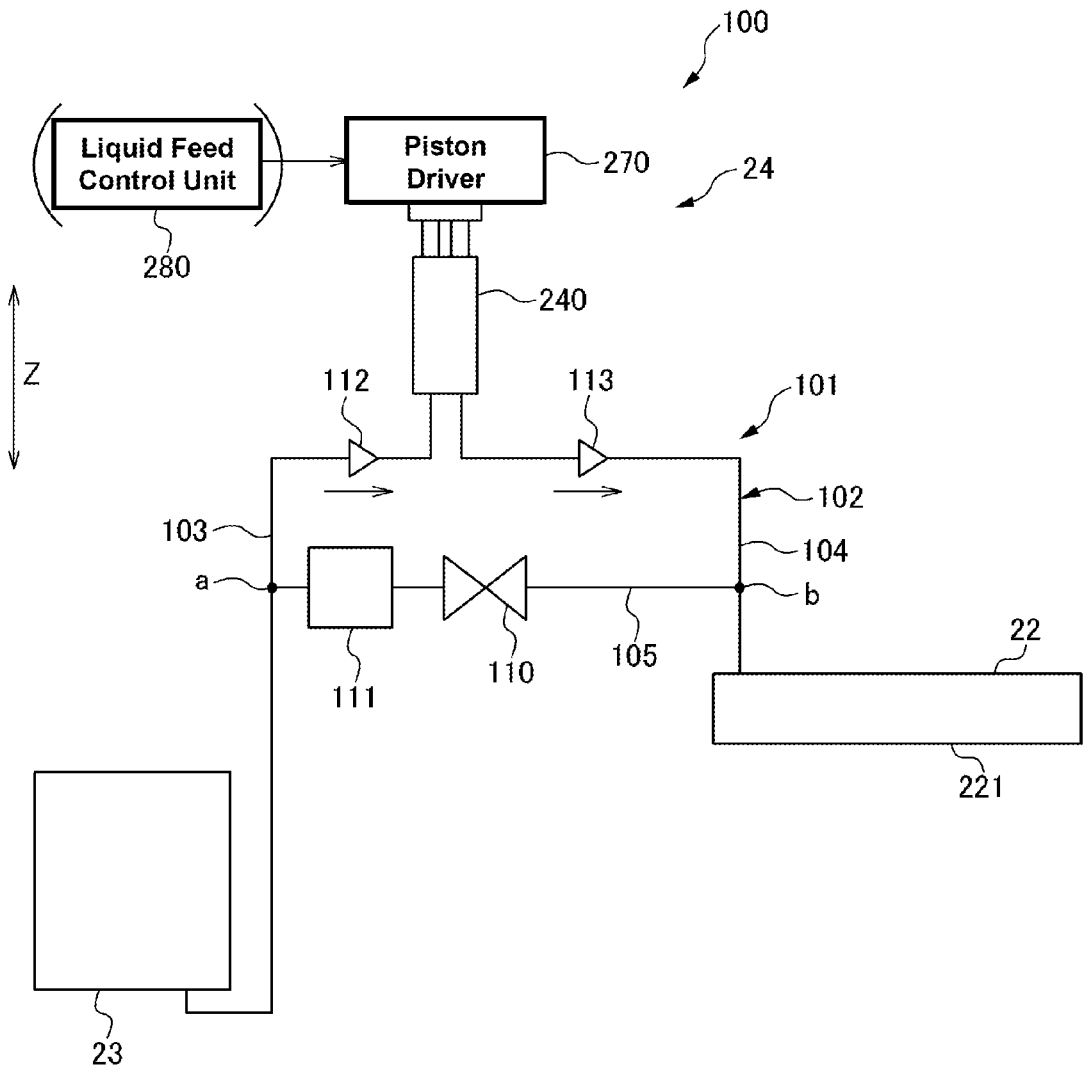
FIG. 3 illustrates, in a diagrammatic form, a structure of an ink supply unit in the inkjet recording apparatus according to the first embodiment.
Figure 4:
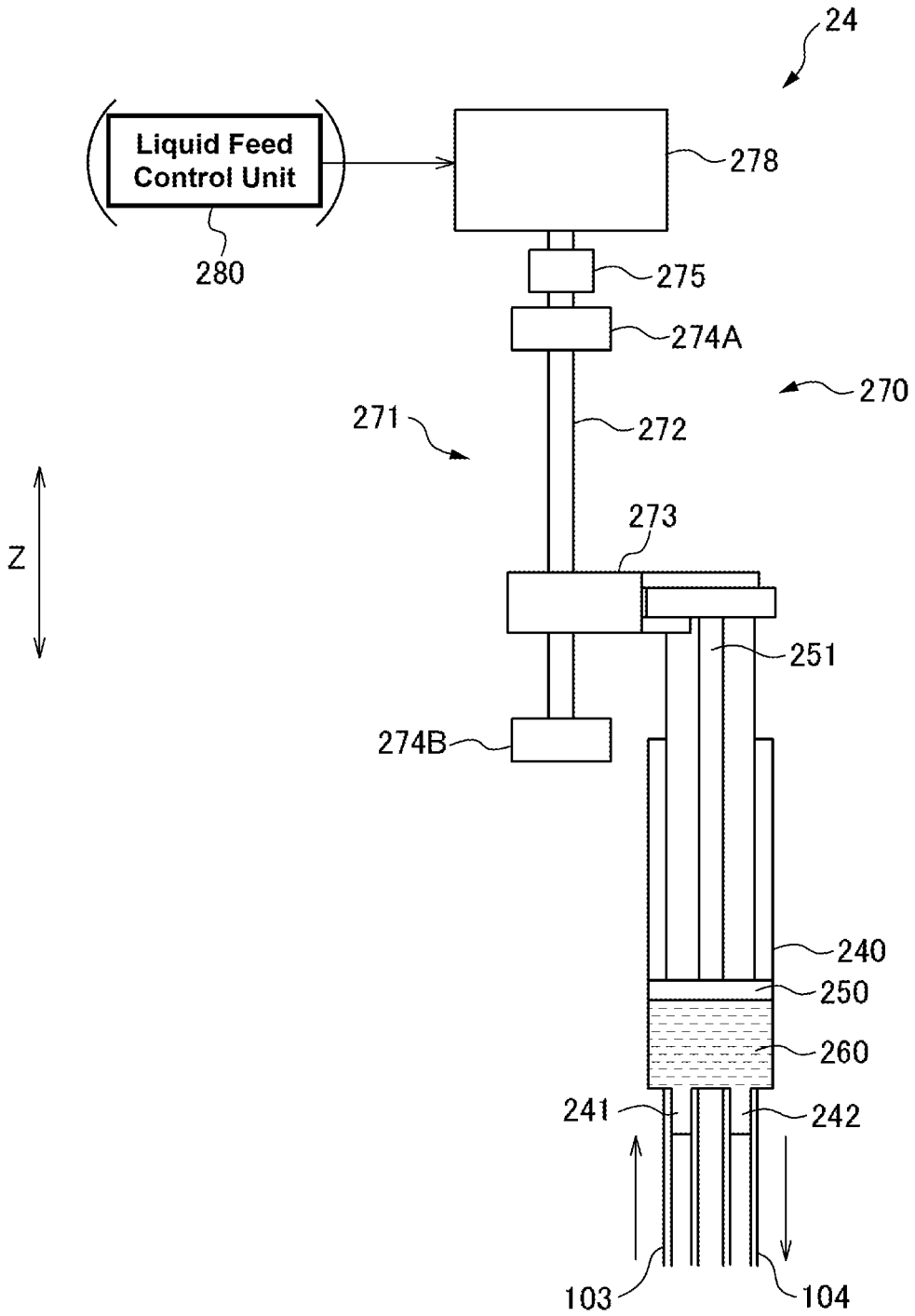
FIG. 4 is a schematic view, partly sectioned, to explain a structure of a pump mechanism in the inkjet recording apparatus according to the first embodiment.

Referring now to FIGS. 3 and 4, a construction related to the pump mechanism 24 of the ink supply unit 100 in the inkjet recording apparatus 1 according to the first embodiment will now be described. FIG. 3 illustrates, in a diagrammatic form, the structure of the ink supply unit 100 in the inkjet recording apparatus 1 according to the first embodiment. FIG. 4 is a schematic view, partly sectioned, to explain the structure of the pump mechanism 24 in the inkjet recording apparatus 1, according to the first embodiment.

As illustrated in FIG. 3, in the first embodiment, the ink supply unit 100 includes the ink tank 23, the pump mechanism 24, an ink supply path 101, a first on-off valve 110, a first check valve 112, a second check valve 113, and a pump 111 for printing.

The ink tank 23 contains the ink that may be supplied to the recording head 22.

In one example embodiment, the ink contained in the ink tank 23 may be supplied to the recording head 22 through the ink supply path 101. The ink supply path 101 may include a purging-ink-supply path 102 used for purging, and a printing-ink-supply path 105 used for printing, which serves as a bypass supply path.

In this embodiment, the purging ink supply path 102 (i.e., liquid feed path) is an ink supply path used in the purge operation. The purging ink supply path 102 may be configured to be able to supply (feed) a large amount of ink to the recording head 22, for example. The pump mechanism 24, described later, may be disposed in the purging ink supply path 102 (specifically, at an intermediate position of the purging ink supply path 102). Here, the term "purging" implies, as mentioned above, the ejection recovery process for forcibly supplying the ink to the recording head 22 and releasing any nozzle clogging in the recording head 22.

The purging ink supply path 102 may include a supply path 103 on the side closer to the ink tank, and a supply path 104 on the side closer to the recording head. The ink tank side supply path 103 may connect the ink tank 23 and the later-described pump mechanism 24 (specifically, a cylinder 240) to each other. The ink tank side supply path 103 may serve to supply the ink contained in the ink tank 23 to the pump mechanism 24.

The recording head side supply path 104 may connect the later-described pump mechanism 24 (specifically, the cylinder 240) and the recording head 22 to each other. The recording head side supply path 104 serves to supply the ink contained in the pump mechanism 24 (specifically, the cylinder 24) to the recording head 22.

The printing ink supply path 105 may connect the ink tank side supply path 103 and the recording head side supply path 104 to each other. More specifically, the printing ink supply path 105 may connect a position a (shown midway in the ink tank side supply path 103) and a position b (shown midway in the recording head side supply path 104) to each other. Stated another way, the printing ink supply path 105 may connect the ink tank 23 and the recording head 22 to each other while bypassing the pump mechanism 24. The printing ink supply path 105 serves to supply the ink contained in the ink tank 23 to the recording head 22 during the printing.

In this embodiment, the purging ink supply path 102 (the ink tank side supply path 103 and the recording head side supply path 104) and the printing ink supply path 105 may each be a cylindrical tube.

The first on-off valve 110 may be disposed in the printing ink supply path 105 (specifically, at an intermediate position of the printing ink supply path 105). The first on-off valve 110 can selectively open or close the printing ink supply path 105.

When the first on-off valve 110 is in an open state, the ink contained in the ink tank 23 is allowed to flow toward the recording head 22 through the printing ink supply path 105. When the first on-off valve 110 is in a closed state, the ink contained in the ink tank 23 is not allowed to flow toward the recording head 22 through the printing ink supply path 105. The first on-off valve 110 is constituted as, e.g., an electromagnetic on-off valve or an electrically-driven on-off valve.

The first on-off valve 110 may be selectively switched to the open state or the closed state by a valve on-off driver (not illustrated), for example.

The pump 111, used for printing, may be disposed midway the printing ink supply path 105 on the side upstream of the first on-off valve 110. The printing pump 111 may supply the ink contained in the ink tank 23 to the recording head 22 when the first on-off valve 110 is in the open state during the printing, for example.

The first check valve 112 may be disposed midway in the ink tank side supply path 103 on the side downstream of the position a at which the ink tank side supply path 103 is connected to the printing ink supply path 105. The first check valve 112 may restrict an ink flow direction. The first check valve 112 may allow the ink to be supplied in a direction (denoted by the arrows in FIG. 3) in which the ink flows from the ink tank 23 to the pump mechanism 24, and may not allow the ink to be supplied in a reverse direction.

The second check valve 113 may be disposed midway in the recording head side supply path 104 on the side upstream of the position b at which the recording head side supply path 104 is connected to the printing ink supply path 105. As with the first check valve 112, the second check valve 113 may also restrict an ink flow direction. The second check valve 113 may allow the ink to be supplied in a direction (denoted by an arrow in FIG. 3) in which the ink flows from the pump mechanism 24 to the recording head 22, and it may not allow the ink to be supplied in a reverse direction.

As illustrated in FIG. 3, the pump mechanism 24 (liquid feed unit) may be disposed in the purging ink supply path 102 (specifically, at an intermediate position of the purging ink supply path 102).

As illustrated in FIG. 4, the pump mechanism 24 may include a syringe pump including a cylinder 240 (syringe portion), a piston 250 (plunger portion), a reservoir 260, and a piston driver 270 (moving mechanism).

The pump mechanism 24 may supply the ink contained in the ink tank 23 to the recording head 22 through the purging ink supply path 102 (liquid feed path).

The cylinder 240 may be formed in a cylindrical shape extending in the vertical direction Z. The cylinder 240 may be opened at its upper end. An ink suction port 241 and an ink ejection port 242 may be formed at a lower end of the cylinder 240. The ink suction port 241 may be connected to the ink tank 23 through the ink tank side supply path 103. The ink ejection port 242 may be connected to the recording head 22 through the recording head side supply path 104.

The piston 250 may be disposed inside the cylinder 240 in such a state that an outer peripheral surface of the piston 250 may be held in contact with an inner peripheral surface of the cylinder 240 so as to close an opening of the cylinder 240. The piston 250 may be reciprocally movable in the vertical direction Z in the state where it is disposed inside the cylinder 240. A piston rod 251 may be coupled to an upper surface of the piston 250, and may extend upward through the inside of the cylinder 240.

The reservoir 260 may temporarily contain the ink that is supplied to the purging ink supply path 102. The reservoir 260 may constitute a space defined by both the inner peripheral surface of the cylinder 240 and an inner surface of the piston 250 (i.e., a lower surface thereof when viewed in the vertical direction Z).

The piston driver 270 may include a ball screw mechanism 271 and a motor 278.

The ball screw mechanism 271 may include a ball screw shaft member 272, a ball-nut member 273, and a pair of support members 274A and 274B.

The ball screw shaft member 272 may be formed to extend in the vertical direction Z. The ball screw shaft member 272 has a male screw on its outer peripheral surface. The pair of support members 274A and 274B may rotatably support the ball screw shaft member 272 at an upper end side and a lower end side thereof, respectively.

The ball-nut member 273 may include a female screw in its inner peripheral surface. The ball screw shaft member 272 may be meshed with the female screw of the ball-nut member 273 with a plurality of balls (not illustrated) interposed between them.

An end of the ball-nut member 273 may be coupled to an upper end of the piston rod 251. Because the ball-nut member 273 may be coupled to the piston rod 251, rotation of the ball-nut member 273 may be restricted even when the ball screw shaft member 272 is meshed with the female screw of the ball-nut member 273 may be rotated. With the rotation of the ball screw shaft member 272, the ball-nut member 273 may be reciprocally moved in an axial direction of the ball screw shaft member 272 (i.e., in the vertical direction Z).

The motor 278 may be connected to an upper end of the ball screw shaft member 272 through a coupling 275. Thus, the motor 278 may rotate the ball screw shaft member 272 through the coupling 275. When the motor 278 rotates the ball screw shaft member 272, the ball-nut member 273 meshed with the ball screw shaft member 272 may be reciprocally moved in the axial direction of the ball screw shaft member 272 (i.e., in the vertical direction Z).

For example, when the motor 278 is rotated in a negative direction (e.g., counterclockwise when viewed from above), the ball-nut member 273 is moved downward in the vertical direction Z. When the motor 278 is rotated in a positive direction (e.g., clockwise when viewed from above), the ball-nut member 273 may be moved upward in the vertical direction Z.

With the reciprocal movement of the ball-nut member 273 in the vertical direction Z, the piston 250 may be reciprocally moved in the vertical direction Z through the piston rod 251 that is coupled to the ball-nut member 273. Thus, the piston driver 270 may pressurize or depressurize the inside of the reservoir 260.

More specifically, the piston driver 270 may depressurize the ink contained in the reservoir 260 when the piston 250 is moved upward in the vertical direction Z.

The piston driver 270 may pressurize the ink contained in the reservoir 260 when the piston 250 is moved downward in the vertical direction Z.

With the construction described above, the pump mechanism 24 may cause the ink to be sucked into the reservoir 260 through the ink suction port 241 when the piston driver 270 moves the piston 250 upward in the vertical direction Z.

Further, the pump mechanism 24 may cause the ink to be delivered from the ink ejection port 242 to the recording head side supply path 104 by moving the piston 250 downward in the vertical direction Z with the piston driver 270. In other words, the pump mechanism 24 operates such that the ink may be delivered to the recording head 22 through the recording head side supply path 104 when the piston driver 270 moves the piston 250 downward in the vertical direction Z.

Here, a flow rate of the ink flowing into the recording head 22 may be adjusted by adjusting, in the pump mechanism 24, a moving speed at which the piston driver 270 moves the piston 250 downward in the vertical direction Z.

Similarly, an amount of the ink supplied (fed) to the recording head 22 may be adjusted by adjusting, in the pump mechanism 24, a distance through which the piston driver 270 moves the piston 250 downward in the vertical direction Z (e.g., a moving speed and a moving time of the piston 250).

The piston driver 270 (motor 278) is controlled by a liquid feed control unit 280 described later.

Figure 5:
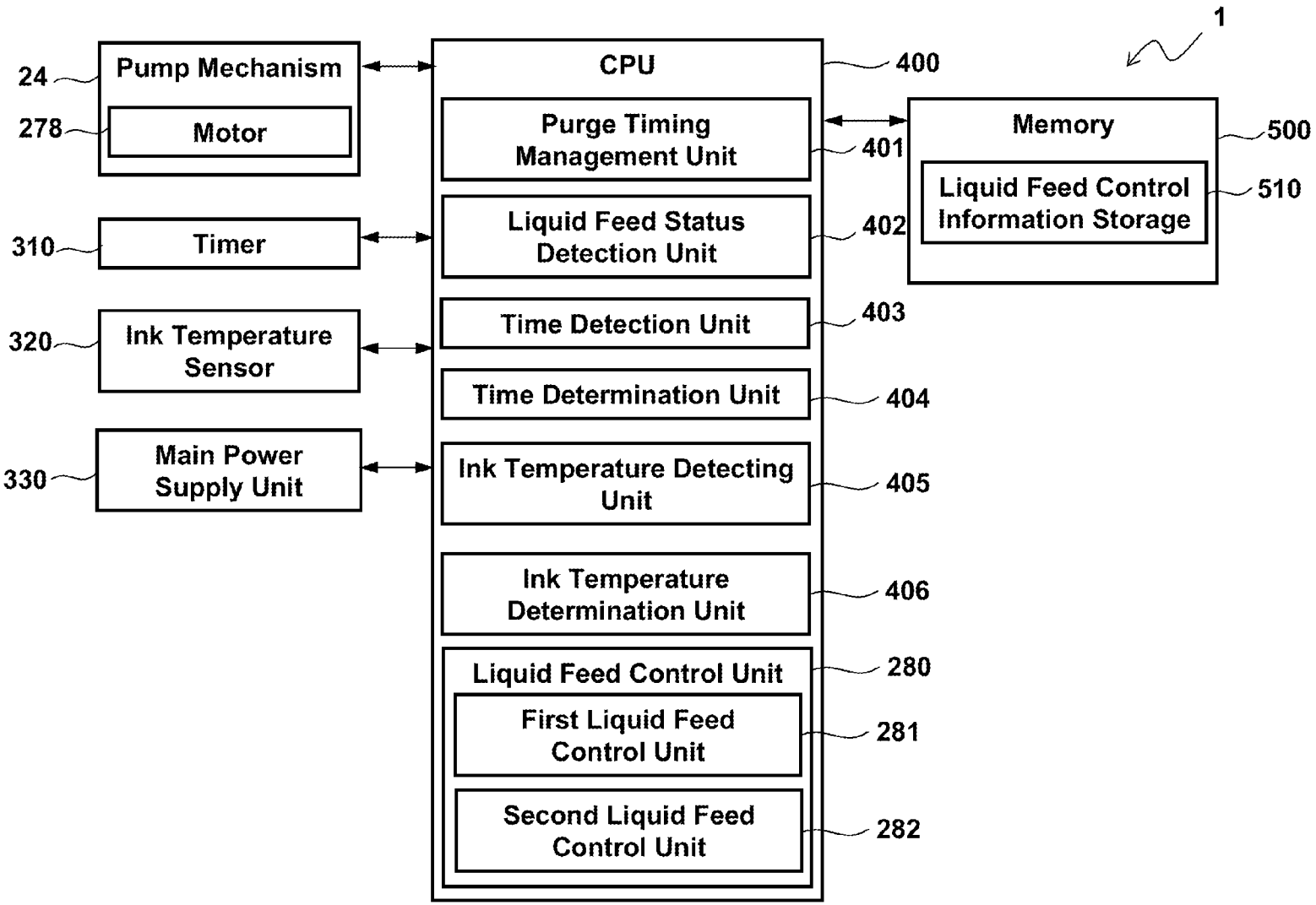
FIG. 5 is a functional block diagram of the inkjet recording apparatus according to the first embodiment.

Referring now to FIG. 5, configurations of functional units in the inkjet recording apparatus 1 according to the first embodiment will be described below with reference to FIG. 5, and FIGS. 6A-6D.

FIG. 5 is a functional block diagram of the inkjet recording apparatus 1 according to the first embodiment. FIG. 6A illustrates a preliminary purge execution/non-execution management table 511 stored in a memory 500 (liquid-feed control information storage 510). FIG. 6B illustrates a preliminary purge flow rate management table 512 stored in the memory 500 (liquid-feed control information storage 510). FIG. 6C illustrates a main purge flow rate management table 513 stored in the memory 500 (liquid-feed control information storage 510). FIG. 6D illustrates a motor driving information management table 514 stored in the memory 500 (liquid-feed-control-information storage 510).

As illustrated in FIG. 5, the inkjet recording apparatus 1 includes the above-described pump mechanism 24, a timer 310, an ink temperature sensor 320, a main power supply unit 330, a CPU 400, and a memory 500.

The pump mechanism 24 may be configured as described above.

The pump mechanism 24 may be controlled by a liquid feed control unit 280. More specifically, the motor 278 of the pump mechanism 24 may be controlled by the liquid feed control unit 280.

The motor 278 may be designed to be able to execute a main purge of feeding the ink to the recording head 22 at a predetermined flow rate, and a preliminary purge of feeding the ink to the recording head 22 at a flow rate not higher than the predetermined flow rate; the preliminary purge being executed prior to the main purge.

The motor 278 may be operated to execute the main purge in accordance with an instruction from the liquid feed control unit 280. Further, the motor 278 is operated to execute the preliminary purge and the main purge in accordance with an instruction from the liquid feed control unit 280.

The motor 278 may be selectively switched to a rotating state or a stopped state by the liquid feed control unit 280. A rotation number (speed) and a rotation time of the motor 278 may be controlled in the rotating state.

The rotation number of the motor 278 may be controlled by the liquid feed control unit 280. The flow rate of the ink fed to the recording head 22 may be adjusted with the rotation number of the motor 278 under control by the liquid feed control unit 280.

Further, the rotation time of the motor 278 may be controlled by the liquid feed control unit 280. The amount of the ink fed to the recording head 22 is adjusted with the rotation time of the motor 278 under control by the liquid feed control unit 280.

The rotation number and the rotation time of the motor 278 may be controlled by the liquid feed control unit 280 in accordance with motor driving information that is stored in the liquid-feed control information storage 510 (motor-driving information management table 514) described later in this disclosure.

The timer 310 may output time information. The timer 310 may output the time information to the CPU 400, for example. The timer 310 may further output the time information to a time detection unit 403.

In this embodiment, the timer 310 may constitute a time counting unit in cooperation with the time detection unit 403.

The ink temperature sensor 320 may obtain temperature information of the ink supplied to the recording head 22 and may output the temperature information to the CPU 400, for example. The ink temperature sensor 320 may output the temperature information of the ink supplied to the recording head 22 to an ink temperature detecting unit 405 described later in this disclosure.

In this embodiment, the ink temperature sensor 320 constitutes an ink temperature detection unit in cooperation with the ink temperature detecting unit 405.

The main power supply unit 330 may be selectively switchable to an on-state where electric power may be supplied to the above-described various operation units, and to an off-state where electric power may not be supplied to the operation units.

Here, even when the main power supply unit 330 is in the off-state, standby electric power may be supplied to the timer 310.

Furthermore, when the main power supply unit 330 is in the off-state, the ink may not be supplied to the recording head 22.

The CPU 400 may include a purge timing management unit 401, a liquid-feed status detection unit 402, a time detection unit 403, a time determination unit 404, the ink temperature detecting unit 405, an ink temperature determination unit 406, and the liquid feed control unit 280.

The purge timing management unit 401 may control the time determination unit 404 so as to obtain time-detection result information from the time detection unit 403, described later, at a predetermined timing, and to make determination as to the obtained information.

For example, when the main power supply unit 330 is switched from the off-state to the on-state, the purge timing management unit 401 may control the time determination unit 404 so as to obtain the time-detection result information from the time detection unit 403, and to make a determination as to the obtained information. Furthermore, the purge timing management unit 401 may cause the time determination unit 404 to make the determination at a predetermined time interval, for example. As another example, when a reception unit (not illustrated) receives a purge-operation start instruction, the purge timing management unit 401 may cause the time determination unit 404 to make the determination.

The liquid-feed status detection unit 402 may detect a feed status of the ink supplied to the recording head 22.

The liquid-feed status detection unit 402 may output a predetermined signal to the time determination unit 404 when the ink feed to the recording head 22 is stopped.

The liquid-feed status detection unit 402 may detect the ink feed status by monitoring an operation status of the motor 278, or may detect the ink feed status by detecting a flow of the ink in the recording-head side supply path 104, for example.

The time detection unit 403 may measure, based on the detection result in the liquid-feed status detection unit 402, a stop time that lapses from the timing at which the ink feed to the recording head 22 has been stopped.

In more detail, the time detection unit 403 may measure, based on both the time information from the timer 310 and the detection result in the liquid-feed status detection unit 402, a time lapsed from the stopping of the ink feed to the recording head 22 (that is, a time which lapses from the stopping of the ink feed to the head unit). Thus, the time detection unit 403 measures a time lapsed in the state where the ink is not fed to the recording head 22.

The time detection unit 403 outputs information of the measured stop time to the liquid feed control unit 280, which is described later in this disclosure.

In this embodiment, the time detection unit 403 may constitute the time counting unit in cooperation with the timer 310.

The time determination unit 404 may determine whether the stop time measured by the time detection unit 403 is not shorter than a first time (e.g., 24 hours).

The time determination unit 404 may obtain information of the stop time, i.e., information of a time (measured time) lapsed from the stopping of the ink feed to the recording head 22, from the time detection unit 403 and may determine whether the stop time indicated by the obtained information of the stop time is not shorter than the first time.

The time determination unit 404 may output a determination result to the liquid feed control unit 280 (specifically, a first liquid feed control unit 281).

Further, the time determination unit 404 may determine that the stop time measured by the time detection unit 403 falls within one of three time zones: (1) a first time zone not shorter than the first time; (2) a second time zone not shorter than a second time, but shorter than the first time, and the second time being shorter than the first time; and (3) a third time zone shorter than the second time (e.g., first time>second time, and first time zone>second time zone>third time zone). The time determination unit 404 outputs a determination result to the liquid feed control unit 280 (second liquid feed control unit 282).

The ink temperature detecting unit 405 detects, based on the temperature information from the ink temperature sensor 320, a temperature of the ink fed to the recording head 22.

The ink temperature detecting unit 405 outputs, to the ink temperature determination unit 406, the temperature information related to the detected temperature.

The ink temperature determination unit 406 determines that the ink temperature detected by the ink temperature detecting unit 405 falls within at least one of three temperature zones. The temperature zones may include a first temperature zone not lower than a first temperature, a second temperature zone not lower than a second temperature but lower than the first temperature, the second temperature being lower than the first temperature, and a third temperature zone that is lower than the second temperature (i.e., first temperature>second temperature, and first temperature zone>second temperature zone>third temperature zone).

The ink temperature determination unit 406 outputs a determination result to the liquid feed control unit 280.

The liquid feed control unit 280 includes the first liquid feed control unit 281 and the second liquid feed control unit 282.

The first liquid feed control unit 281 controls the pump mechanism 24 (liquid feed unit) to execute the preliminary purge.

The first liquid feed control unit 281 controls the pump mechanism 24 to execute the preliminary purge when the stop time measured by the time detection unit 403 is not shorter than the first time, and it controls the pump mechanism 24 not to execute the preliminary purge when the stop time is shorter than the first time (see FIG. 6A).

In this embodiment, the first liquid feed control unit 281 sets flow rates in the preliminary purge, which correspond to the three temperature zones, to the same flow rate (see FIG. 6B).

The second liquid feed control unit 282 controls the pump mechanism 24 (liquid feed unit) to execute the main purge.

When the preliminary purge is executed, the second liquid feed control unit 282 controls the pump mechanism 24 (liquid-feed unit) to execute the main purge after executing the preliminary purge.

When the preliminary purge is not executed, the second liquid feed control unit 282 controls the pump mechanism 24 (liquid feed unit) to execute the main purge at a predetermined timing.

The second liquid feed control unit 282 sets a predetermined flow rate of the ink, i.e., an ink flow rate in the main purge, based on both the stop time measured by the time detection unit 403 and the ink temperature detected by the ink temperature detecting unit 405.

More specifically, the second liquid feed control unit 282 may set, as the predetermined flow rate, a flow rate corresponding to each temperature zone of the ink, for each of the time zones (see FIG. 6C).

The second liquid feed control unit 282 sets the predetermined flow rate such that, in each of the time zones, the flow rate corresponding to the first temperature zone is higher than that corresponding to the third temperature zone.

In more detail, the second liquid feed control unit 282 sets the predetermined flow rate to a first flow rate when the time determination unit 404 determines that the stop time falls within the first time zone and when the ink temperature determination unit 406 determines that the ink temperature falls within the first temperature zone.

Further, the second liquid feed control unit 282 sets the predetermined flow rate to be not lower than a second flow rate but lower than the first flow rate (the second flow rate is lower than the first flow rate), when the time determination unit 404 determines that the stop time falls within the first time zone and when the ink temperature determination unit 406 determines that the ink temperature falls within the second temperature zone.

The second liquid feed control unit 282 sets the predetermined flow rate to the second flow rate when the time determination unit 404 determines that the stop time falls within the first time zone and when the ink temperature determination unit 406 determines that the ink temperature falls within the third temperature zone.

The second liquid feed control unit 282 sets the predetermined flow rate to the second flow rate when the time determination unit 404 determines that the stop time falls within the second time zone and when the ink temperature determination unit 406 determines that the ink temperature falls within the first temperature zone.

The second liquid feed control unit 282 sets the predetermined flow rate to be not lower than a third flow rate but lower than the second flow rate (the third flow rate is lower than the second flow rate), when the time determination unit 404 determines that the stop time falls within the second time zone and when the ink temperature determination unit 406 determines that the ink temperature falls within the second temperature zone.

The second liquid feed control unit 282 sets the predetermined flow rate to the third flow rate when the time determination unit 404 determines that the stop time falls within the second time zone and when the ink temperature determination unit 406 determines that the ink temperature falls within the third temperature zone.

The second liquid feed control unit 282 sets the predetermined flow rate to the first flow rate when the time determination unit 404 determines that the stop time falls within the third time zone and when the ink temperature determination unit 406 determines that the ink temperature falls within the first temperature zone.

The second liquid feed control unit 282 sets the predetermined flow rate to be not lower than the second flow rate but lower than the first flow rate, when the time determination unit 404 determines that the stop time falls within the third time zone and when the ink temperature determination unit 406 determines that the ink temperature falls within the second temperature zone.

The second liquid feed control unit 282 sets the predetermined flow rate to the second flow rate when the time determination unit 404 determines that the stop time falls within the third time zone and when the ink temperature determination unit 406 determines that the ink temperature falls within the third temperature zone (see FIG. 6C).

In this embodiment, the predetermined flow rate implies an average flow rate. In this embodiment, therefore, the second liquid feed control unit 282 executes the main purge, for example, by controlling the pump mechanism 24 (liquid feed unit) such that the average flow rate is held at the predetermined flow rate.

In the above-described case, as seen from FIG. 6C, when it is determined that the stop time falls within the second time zone, the predetermined flow rate is set, for example, to be lower than that set when it is determined that the stop time falls within the third time zone. However, the predetermined flow rate may be set such that the relationship between the flow rate set when the stop time is determined to be within the second time zone and the flow rate set when the stop time is determined to be within the third time zone is reversed to the above-mentioned relationship. For example, when the stop time is determined to be within the second time zone, the predetermined flow rates may be set to the first flow rate, the flow rate not lower than the second flow rate but lower than the first flow rate, and the second flow rate, respectively, when the ink temperature is determined to be within the first, second and third temperature zone. On the other hand, when the stop time is determined to be within the third time zone, the predetermined flow rates may be set to the second flow rate, the flow rate not lower than the third flow rate but lower than the second flow rate, and the third flow rate, respectively, when the ink temperature is determined to be within the first, second and third temperature zone. For example, when the second time is set to a relatively short time and the ink viscosity is not so increased even in the second time zone, breakage and other damages of members constituting the ink flow paths and the pump mechanism can be suppressed even with the flow rate set to be relatively high in the second time zone as mentioned above. In such a case, the flow rates in the second time zone and the third time zone may be set to substantially the same value.

The second liquid feed control unit 282 can control the pump mechanism 24 not only to continuously or intermittently feed the ink, but also to change the flow rate in the main purge to such an extent that the average flow rate is held at the predetermined flow rate.

For example, the second liquid feed control unit 282 can control the pump mechanism 24 such that the flow rate is relatively slow in an initial stage of the main purge and is increased from some midpoint.

In that case, strong pressure can be applied to the recording head 22 after a damper effect (i.e., an effect of absorbing an abrupt pressure rise) has been developed on the recording head 22.

As an alternative example, the second liquid feed control unit 282 may control the pump mechanism 24 such that the flow rate is relatively fast in the initial stage of the main purge and is reduced from some midpoint.

In that case, a state where the ink is fed under strong pressure may be maintained for a longer time in the recording head 22.

As another example, the second liquid feed control unit 282 may control the pump mechanism 24 such that the ink is intermittently fed.

As still another example, the second liquid feed control unit 282 may control the pump mechanism 24 such that the ink is intermittently fed and the flow rate is gradually reduced.

In that case, the purge can be satisfactorily executed in the recording head 22 in a manner of suppressing a failure of the ink ejection.

Moreover, the second liquid feed control unit 282 may intermittently feed the ink while changing the flow rate in an initial stage of the ink feed as described above.

In addition, the second liquid feed control unit 282 may set a flow volume of the supplied ink corresponding to the flow rate.

In this embodiment, the second liquid feed control unit 282 sets the flow volume such that a flow volume corresponding to the first flow rate is not less than that corresponding to the second flow rate.

As described above, the liquid feed control unit 280 (the first liquid feed control unit 281 and the second liquid feed control unit 282) determines whether the preliminary purge is to be executed or not, sets the flow rate in the preliminary purge, and sets the flow rate in the main purge by referring to the memory 500 including the liquid-feed control information storage 510 (specifically, the preliminary purge execution/non-execution management table 511, the preliminary purge flow rate management table 512, and the main purge flow rate management table 513), which are described in more detail later.

Further, the liquid feed control unit 280 (the first liquid feed control unit 281 and the second liquid feed control unit 282) controls the pump mechanism 24 (motor 278) by referring to the memory 500, i.e., the liquid-feed control information storage 510 (specifically, the motor-driving information management table 514), which is described in more detail later.

The liquid feed control unit 280 (the first liquid feed control unit 281 and the second liquid feed control unit 282) controls the pump mechanism 24 (motor 278) such that the ink is fed at the flow rate, which is set as described above, until reaching the set flow volume.

More specifically, the first liquid feed control unit 281 and the second liquid feed control unit 282 control the motor 278 to rotate at a motor rotation number (rpm) for a driving time measured in seconds (s), which are set for each flow rate (see FIG. 6D). For example, as illustrated in FIG. 6D, when the predetermined flow rate is set to the first flow rate, the motor 278 is controlled to rotate at a motor rotation number A (rpm) for a driving time a (s). When the predetermined flow rate is set to the second flow rate, the motor 278 is controlled to rotate at a motor rotation number B (rpm) for a driving time b (s). When the predetermined flow rate is set to the third flow rate, the motor 278 is controlled to rotate at a motor rotation number C (rpm) for a driving time c (s). At that time, the control is performed, for example, such that the motor rotation numbers satisfy a relationship of A>B>C, and the driving times satisfy a relationship of a>b>c. As an alternative, when the predetermined flow rate is set to be not lower than the second flow rate but lower than the first flow rate, the motor rotation number may be set to be less than A (rpm) but not less than B (rpm), and the driving time may be set to be shorter than a (s) but not shorter than b (s). Similarly, when the predetermined flow rate is set to be not lower than the third flow rate but lower than the second flow rate, the motor rotation number may be set to be less than B (rpm) but not less than C (rpm), and the driving time may be set to be shorter than b (s) but not shorter than c (s).

Furthermore, the flow rates may be set such that respective target pressures corresponding to the first flow rate, the second flow rate, and the third flow rate satisfy a relationship of, e.g., the target pressure corresponding to the first flow rate>the target pressure corresponding to the second flow rate>the target pressure corresponding to the third flow rate. For example, the flow rates may be set such that the target pressure corresponding to the first flow rate, the target pressure corresponding to the second flow rate, and the target pressure corresponding to the third flow rate are respectively 120 kPa, 90 kPa, and 30 kPa.

As described above, the memory 500 may include the liquid-feed control information storage 510.

The liquid-feed control information storage 510 may contain the preliminary purge execution/non-execution management table 511, the preliminary purge flow rate management table 512, the main purge flow rate management table 513, and motor-driving information management table 514.

As illustrated in FIG. 6A, the preliminary purge execution/non-execution management table 511 stores information as to whether the preliminary purge is to be executed or not, the information being set for each of the time zones.

The preliminary purge execution/non-execution management table 511 is referred to by the first liquid feed control unit 281.

In this embodiment, the preliminary purge execution/non-execution management table 511 may store information indicating that the preliminary purge is to be executed when the stop time is not shorter than the first time (i.e., the stop time is within the first time zone), and that the preliminary purge is not to be executed when the stop time is shorter than the first time (i.e., the stop time is within the second time zone or the third time zone).

As illustrated in FIG. 6B, the preliminary purge flow rate management table 512 may store information regarding the ink flow rate in the preliminary purge, the information being set for each of the time zones.

The preliminary purge flow rate management table 512 is referred to by the first liquid feed control unit 281.

In this embodiment, the preliminary purge flow rate management table 512 may store information indicating that the flow rate in the preliminary purge is set only when the stop time is not shorter than the first time (i.e., within the first time zone), and that the flow rate is set to the third flow rate (low rate) in any of the temperature zones.

As illustrated in FIG. 6C, the main purge flow rate management table 513 may store information regarding the ink flow rate that is set for each of combinations of the time zones and the temperature zones.

The main purge flow rate management table 513 is referred to by the second liquid feed control unit 282.

In this embodiment, the main purge flow rate management table 513 stores information regarding the flow rate that is set based on both the stop time information measured by the time detection unit 403 and the ink temperature information detected by the ink temperature detecting unit 405.

As illustrated in FIG. 6D, the motor-driving information management table 514 stores information of the motor rotation number (rpm), information of the driving time (s), and information of the flow volume (ml), which are set for each flow rate.

The motor-driving information management table 514 is referred to by the first liquid feed control unit 281 and the second liquid feed control unit 282.

In this embodiment, the motor-driving information management table 514 stores information of the motor rotation number (rpm) that provides each of the flow rates, and information of the driving time (s) that provides each of the set flow volumes (ml).

As practical values of the first and second times described above, the first time may be set to 168 hours (1 week) and the second time may be set to 24 hours (1 day), for example.

In that case, the first time zone is not shorter than 168 hours (1 week), the second time zone is not shorter than 24 hours (1 day) but shorter than 168 hours (1 week), and the third time zone is shorter than 24 hours (1 day).

When finer control is to be performed, the number of the time zones may be increased. For example, the third time may be set to 1 hour, and a new fourth time zone may be set to be not shorter than 1 hour but shorter than 24 hours (1 day). In this case, the flow rate in the main purge, which is set corresponding to the fourth time zone, is set to be not higher than the flow rate that may be set corresponding to the third time zone.

Moreover, the number of the time zones may be increased by narrowing a time width in each of the time zones. In this case, the flow rate may be of course set in a larger number of steps.

As practical values of the first and second temperatures, the first temperature may be set to 28° C. and the second temperature may be set to 18° C., for example.

In that case, the first temperature zone is not lower than 28° C., the second temperature zone is not lower than 18° C. but lower than 28° C., and the third temperature zone is lower than 18° C.

When finer control is to be performed, the number of the temperature zones may be increased. For example, the number of the temperature zones may be increased by narrowing a temperature width in each of the temperature zones.

Furthermore, a temperature zone may be set outside a temperature range within which the ink is usually employed.

For example, a high temperature zone (e.g., not lower than 32.5°) may be set. In the high temperature zone, volatile components of the ink are evaporated in larger amount than in the other temperature zones. Therefore, the conditions for the preliminary purge and the main purge may be set significantly different from those for the other temperature zones (e.g., in points of prolonging the time of the preliminary purge, and/or increasing the flow volume in the preliminary purge).

To the contrary, a low temperature zone (e.g., lower than 10° C.) may be set. In the low temperature zone, the ink viscosity is increased in comparison with that in the other temperature zones. Therefore, the conditions for the preliminary purge and the main purge may be set significantly different from those for the other temperature zones (e.g., in a point of reducing the flow rate).

As practical values of the first, second and third flow rates, the first flow rate may be set to 4 ml/s, the second flow rate may be set to 2-3 ml/s, and the third flow rate may be set to 1 ml/s, for example.

Given that the flow volume corresponding to the first flow rate is x, the flow volume corresponding to the second flow rate is y, and the flow volume corresponding to the third flow rate is z, the flow volumes are set so as to satisfy a relationship of, for example, $x>y>z$. As practical values, for example, the flow volume x corresponding to the first flow rate may be set to 4 ml, the flow volume y corresponding to the second flow rate can be set to 2 ml, and the flow volume z corresponding to the third flow rate can be set to 0.5 ml. Alternatively, the flow volume x corresponding to the first flow rate, the flow volume y corresponding to the second flow rate, and the flow volume z corresponding to the third flow rate may be set to the same value. As a practical value, for example, the flow volume x corresponding to the first flow rate, the flow volume y corresponding to the second flow rate, and the flow volume z corresponding to the third flow rate may be each set to 2 ml.

Moreover, the flow volume in the preliminary purge may be set, for example, to the same value in any of the temperature zones.

Figure 7:
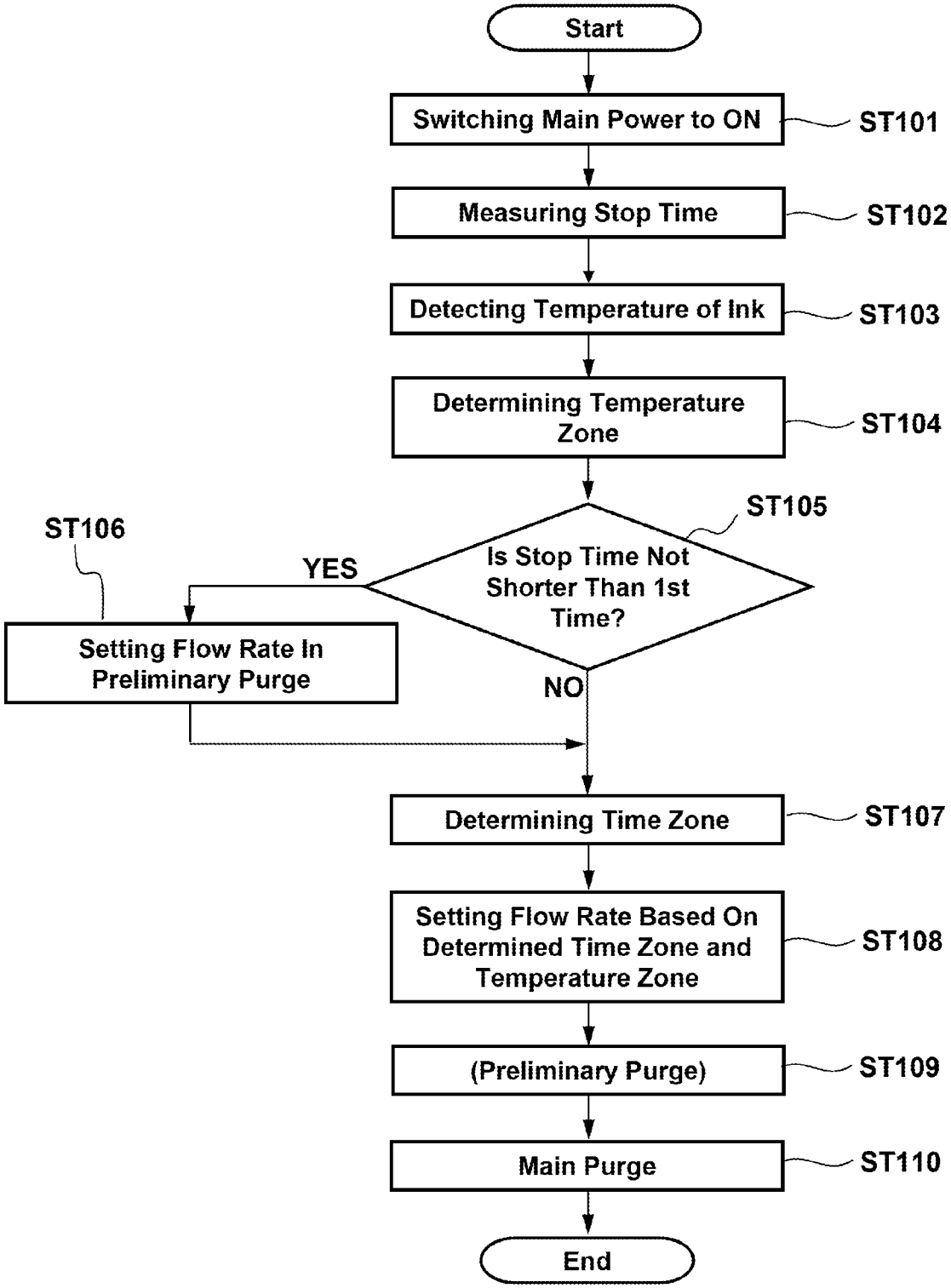
FIG. 7 is a flowchart to explain a purge operation in the inkjet recording apparatus according to the first embodiment.

The purge operation in the inkjet recording apparatus 1 according to the first embodiment will be described below with reference to FIG. 7. FIG. 7 is a flowchart to explain the purge operation in the inkjet recording apparatus 1 according to the first embodiment.

As illustrated in FIG. 7, in step ST101, a user switches over the main power supply unit 330 from the off-state to the on-state. With the power-on, the main power supply unit 330 comes into a state capable of supplying electric power to the various operation units.

In step ST102, the purge timing management unit 401 instructs the time detection unit 403 to measure a stop time. The stop time may be determined by calculating a duration of time for which the ink was stopped from being fed to the recording head 22. Then, the time detection unit 403 measures the time that lapsed from the time the ink was stopped from being fed to the recording head 22 (i.e., the stop time).

In step ST103, the ink temperature detecting unit 405 detects a temperature of the ink fed to the recording head 22. Then, the ink temperature detecting unit 405 outputs a detection result to the ink temperature determination unit 406.

In step ST104, the ink temperature determination unit 406 may determine that the detected temperature falls within one of the first temperature zone, the second temperature zone, and the third temperature zone.

In step ST105, the first liquid feed control unit 281 determines whether the stop time measured by the time detection unit 403 is not shorter than the first time.

If the first liquid feed control unit 281 determines that the stop time is not shorter than the first time (YES in ST105), the process is advanced to step ST106.

In step ST106, the first liquid feed control unit 281 sets the flow rate in the preliminary purge by referring to the liquid-feed control information storage 510. In this embodiment, the first liquid feed control unit 281 sets the flow rate in the preliminary purge to the third flow rate (see FIG. 6B). Thereafter, the process is advanced to step ST107.

On the other hand, if the first liquid feed control unit 281 determines that the stop time is shorter than the first time (NO in ST105), the process is advanced to step ST107.

In step ST107, the time determination unit 404 determines that the detected stop time falls within which one of the first time zone, the second time zone, and the third time zone.

In step ST108, the second liquid feed control unit 282 sets the flow rate in the main purge based on both the determined time zone and the determined temperature zone (see FIG. 6C).

In step ST109, when the preliminary purge is executed, the first liquid feed control unit 281 controls the pump mechanism 24 to execute the preliminary purge by referring to the liquid-feed control information storage 510 (see FIG. 6D).

In this embodiment, the first liquid feed control unit 281 instructs the motor 278 of the pump mechanism 24 to rotate at the motor rotation number C (rpm) for the driving time c (s).

In step ST110, the second liquid feed control unit 282 controls the pump mechanism 24 to execute the main purge by referring to the liquid-feed control information storage 510 (see FIG. 6D).

The second liquid feed control unit 282 instructs the motor 278 of the pump mechanism 24 to rotate at the motor rotation number (rpm) for the driving time (s), which are set corresponding to the set flow rate. For example, when the set flow rate is the first flow rate, the second liquid feed control unit 282 instructs the motor 278 to rotate at the motor rotation number A (rpm) for the driving time a (s). Similarly, when the set flow rate is the second flow rate, the second liquid feed control unit 282 instructs the motor 278 to rotate at the motor rotation number B (rpm) for the driving time b (s). And Similarly, when the set flow rate is the third flow rate, the second liquid feed control unit 282 instructs the motor 278 to rotate at the motor rotation number C (rpm) for the driving time c (s). When the set flow rate is lower than the first flow rate but not lower than the second flow rate, the second liquid feed control unit 282 instructs the motor 278 to rotate at the motor rotation number less than A but not less than B for the driving time shorter than a (s) but not shorter than b (s). When the set flow rate is lower than the second flow rate but not lower than the third flow rate, the second liquid feed control unit 282 instructs the motor 278 to rotate at the motor rotation number less than B but not less than C for the driving time shorter than b (s) but not shorter than c (s).

After the end of the main purge, the series of purge operation steps in the inkjet recording apparatus 1 is brought to an end.

In the purge operation, the various components operate as follows.

The inkjet recording apparatus 1 may maintain the operation of the printing pump 111 in the stopped state, and keeps the first on-off valve 110 closed (namely, maintains it in the closed state). Accordingly, the printing ink supply path 105 is held in the state where the ink does not flow through.

Then, the inkjet recording apparatus 1 may start the purge operation (i.e., the operation of forcibly supplying the ink from the ink tank 23 to the recording head 22).

In more detail, the piston driver 270 drives the motor 278 to rotate in the negative rotating direction (e.g., counterclockwise when viewed from above), thereby rotating the ball screw member 272. Further, the piston driver 270 moves the ball nut member 273 at a first speed in a pressurization direction (i.e., downward in the vertical direction Z). The ball nut member 273 in turn moves the piston 250 through the piston rod 251 at the first speed in the pressurization direction.

As a result, the ink contained in the reservoir 260 is sent to the recording-head side supply path 104 through the ink ejection port 242 and is supplied to the recording head 22. The ink supplied to the recording head 22 is then jetted in a large amount from the nozzle. The purge process is performed in such a manner. Nozzle clogging, for example, is released with the purge process.

Thus, this embodiment can provide the inkjet recording apparatus 1 in which the ink can be fed to the recording head in coping with change of the ink viscosity. In other words, this embodiment can provide the inkjet recording apparatus 1 in which the ink feed to the head unit can be controlled in coping with change of the ink viscosity depending on temperature and with a rise of the ink viscosity due to evaporation.

In the inkjet recording apparatus 1 of this embodiment, the flow rate of the ink fed to the recording head 22 is changed by using, as indices, the stop time measured as the time lapsed from the stopping of the ink feed to the recording head 22, and the ink temperature. According to the inkjet recording apparatus 1 of this embodiment, therefore, the flow rate in the ink feed may be properly changed in the purge operation. Thus, the inkjet recording apparatus 1 of this embodiment may suppress an excessive rise of pressure of the ink fed to the recording head 22.

The inkjet recording apparatus 1 of this embodiment may be configured to automatically execute the preliminary purge when the measured stop time is not shorter than the first time.

Accordingly, the inkjet recording apparatus 1 of this embodiment may first push out the ink, of which viscosity has increased, from the nozzle and then may execute a proper purge in consideration of temperature, etc. As a result, the inkjet recording apparatus 1 of this embodiment may avoid troubles, such as breakage caused by an abrupt pressure rise when the ink is fed, and can satisfactorily develop the purge effect. Furthermore, the inkjet recording apparatus 1 of this embodiment may prevent damages that may be caused due to influences of change in the ink viscosity even when the inkjet recording apparatus 1 is not used for a long period.

As described above, because the ink viscosity varies depending on temperature, the members constituting the ink flow paths and the members constituting the pump mechanism 24 may be damaged, and/or the desired cleaning effect may not be obtained with the purge operation in some cases depending on the ink temperature. In view of that problem, there is proposed an inkjet recording apparatus, which includes temperature detection portion to detect a temperature, and operation changing portion to change operation of a pressurization pump in accordance with a detection result of the temperature detection portion. In the proposed inkjet recording apparatus, however, a variable other than temperature may not be taken into consideration as a factor of increasing the ink viscosity. Thus, the proposed recording apparatus may not be properly adaptable for, for example, the case where the ink viscosity may be changed due to not only viscosity change depending on temperature, but also evaporation of volatile components of the ink for the reason that the ink has not been fed to the recording head for a long time.

In contrast, the embodiment of this disclosure provides, as described above, an image forming apparatus in which the ink may be fed to the recording head in coping with change of the ink viscosity. Thus, in the inkjet recording apparatus 1 according to the first embodiment of this disclosure, the proper purge may be executed, for example, by appropriately modifying the flow rate when the ink is fed in the purge operation, based on not only a rise of the ink viscosity due to temperature change, but also a rise of the ink viscosity caused when the ink feed to the recording head is not performed for a long time.

An example second embodiment of this disclosure will be described below with reference to FIGS. 8 through 10.

Figure 8:
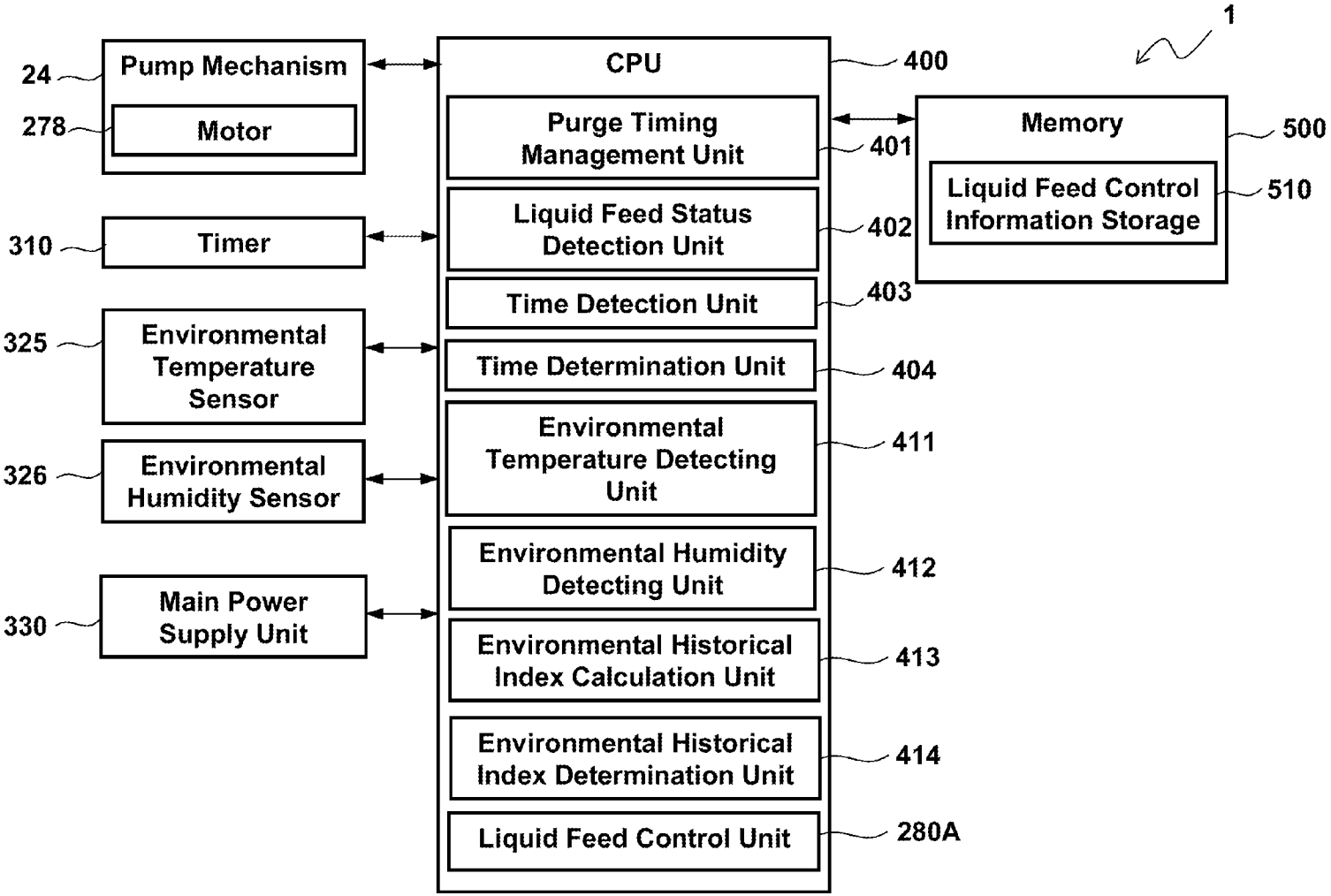
FIG. 8 is a functional block diagram of an inkjet recording apparatus according to a second embodiment.

FIG. 8 is a functional block diagram of an inkjet recording apparatus 1A according to a second embodiment. FIG. 9 illustrates a motor-driving information management table 516 stored in a memory 500A (liquid-feed control information storage 510A). FIG. 10 is a flowchart to explain a purge operation in the inkjet recording apparatus 1A according to the second embodiment.

The second embodiment is described primarily about different points from the first embodiment. Same or similar components to those in the first embodiment are denoted by the same reference symbols and detailed descriptions of those components are omitted. The description in the first embodiment is similarly applied, as appropriate, to points that are not particularly described in the second embodiment.

As illustrated in FIG. 8, the inkjet recording apparatus 1A includes the above-described pump mechanism 24, the timer 310, an environmental temperature sensor 325, an environmental humidity sensor 326, the main power supply unit 330, a CPU 400A, and a memory 500A.

The environmental temperature sensor 325 may obtain temperature information regarding an environmental temperature. The environmental temperature sensor 325 may be mounted to, for example, the backside of the main body 2.

The environmental temperature sensor 325 may obtain temperature information regarding an environmental temperature around the main body 2 and outputs the obtained temperature information to an environmental temperature detecting unit 411, which is described later.

In this embodiment, the environmental temperature sensor 325 constitutes an environmental temperature detection unit in cooperation with the environmental temperature detecting unit 411.

The environmental humidity sensor 326 may obtains humidity information regarding an environmental humidity. The environmental humidity sensor 326 may be disposed, for example, alongside of the environmental temperature sensor 325.

The environmental humidity sensor 326 may obtain humidity information regarding an environmental humidity around the main body 2 and outputs the obtained humidity information to an environmental humidity detecting unit 412 described later.

In this embodiment, the environmental humidity sensor 326 constitutes an environmental humidity detection unit in cooperation with the environmental humidity detecting unit 412.

The CPU 400A includes the purge timing management unit 401, the liquid-feed status detection unit 402, the time detection unit 403, the time determination unit 404, the environmental temperature detecting unit 411, the environmental humidity detecting unit 412, an environmental historical index calculation unit 413, an environmental historical index determination unit 414, and a liquid feed control unit 280A.

The environmental temperature detecting unit 411 may detect an environmental temperature based on the environmental temperature information sent from the environmental temperature sensor 325.

The environmental temperature detecting unit 411 may output the temperature information regarding the detected temperature to the environmental historical index calculation unit 413.

The environmental humidity detecting unit 412 may detect an environmental humidity based on the environmental humidity information sent from the environmental humidity sensor 326.

The environmental temperature detecting unit 412 may output the humidity information regarding the detected humidity to the environmental historical index calculation unit 413.

The environmental historical index calculation unit 413 may calculate an environmental historical index based on a stop time value that is a value of the stop time measured by the time detection unit 403, an environmental temperature value that is value of the environmental temperature detected by the environmental temperature detecting unit 411, and an environmental humidity value that is a value of the environmental humidity detected by the environmental humidity detecting unit 412. A larger environmental historical index implies that a solvent, etc. contained in the ink is more apt to evaporate and the ink viscosity is increased.

The environmental historical index calculation unit 413 may calculate the environmental historical index based on, for example, the product of the detected environmental temperature value and the measured stop time value, and/or the product of a value obtained by subtracting the detected environmental humidity value from a predetermined value and the measured stop time value.

Alternatively, the environmental historical index calculation unit 413 may calculate the environmental historical index based on, for example, the product of a partial value of the detected environmental temperature, which value corresponds to a part exceeding above a predetermined temperature, and the measured stop time value, and/or the product of a partial value of the detected environmental humidity, which value corresponds to a part exceeding below a predetermined humidity, and the measured stop time value.

For example, the environmental historical index may be calculated from the sum of the product of the partial value of the detected environmental temperature, which value corresponds to a part exceeding above the predetermined temperature, and the measured stop time value, and the product of the partial value of the detected environmental humidity, which value corresponds to a part exceeding below the predetermined humidity, and the measured stop time value. As another example, the environmental historical index may be calculated from the product obtained by multiplying the product of the partial value of the detected environmental temperature, which value corresponds to a part exceeding above the predetermined temperature, and the measured stop time value, by the product of the partial value of the detected environmental humidity, which value corresponds to a part exceeding below the predetermined humidity, and the measured stop time value.

The environmental historical index determination unit 414 may determine whether the environmental historical index calculated by the environmental historical index calculation unit 413 is not less than a predetermined value.

For example, the environmental historical index determination unit 414 may determine whether the calculated environmental historical index is not less than a first environmental historical index K1, or not less than a second environmental historical index K2, or not less than a third environmental historical index K3 (see FIG. 9). In this embodiment, the first, second and third environmental historical indices K1, K2 and K3 are set in a relationship of $K1<K2<K3$.

The liquid feed control unit 280A controls the pump mechanism 24 (motor 278) in accordance with the environmental historical index calculated by the environmental historical index calculation unit 413.

When the environmental historical index calculated by the environmental historical index calculation unit 413 is not less than the first environmental historical index K1, the liquid feed control unit 280A controls the pump mechanism 24 (motor 278) to feed the ink to the head unit by referring to the memory 500A, i.e., the liquid-feed control information storage 510A (specifically, the motor-driving information management table 516), which is described in more detail later.

The liquid feed control unit 280A controls the pump mechanism 24 (motor 278), for example, such that as the environmental historical index calculated by the environmental historical index calculation unit 413 has a larger value, the ink is fed to the recording head 22 at a higher flow rate. Further, the liquid feed control unit 280A controls the pump mechanism 24 (motor 278), for example, such that when the environmental historical index calculated by the environmental historical index calculation unit 413 has a larger value, the main purge is executed after executing the preliminary purge.

More specifically, when the calculated environmental historical index is not less than the first environmental historical index K1 but less than the second environmental historical index K2, the liquid feed control unit 280A controls the pump mechanism 24 (motor 278) such that the ink is fed to the recording head 22 at the first flow rate for d seconds.

Also, when the calculated environmental historical index is not less than the second environmental historical index K2 but less than the third environmental historical index K3, the liquid feed control unit 280A controls the pump mechanism 24 (motor 278) such that the ink is fed to the recording head 22 at the second flow rate for e seconds.

Moreover, when the calculated environmental historical index is not less than the third environmental historical index K3, the liquid feed control unit 280A controls the pump mechanism 24 (motor 278) such that the ink is fed to the recording head 22 at the third flow rate for f1 seconds and then at the second flow rate for f2 seconds. As this manner, when the calculated environmental historical index is not less than the third environmental historical index K3, the preliminary purge may be executed prior to the main purge.

The memory 500A includes the liquid-feed control information storage 510A.

The liquid-feed control information storage 510A contains the motor-driving information management table 516.

As illustrated in FIG. 9, the motor-driving information management table 516 contains motor-driving information, such as the motor rotation number and the driving time, corresponding to the calculated environmental historical index.

In this embodiment, the information contained in the motor-driving information management table 516 is as follows.

When the calculated environmental historical index is not less than the first environmental historical index K1 but less than the second environmental historical index K2, the motor rotation number is D (rpm) and the motor driving time (liquid feed time) is d (s). In this case, the ink flow rate is the first flow rate and the target pressure is P1.

When the calculated environmental historical index is not less than the second environmental historical index K2, but less than the third environmental historical index K3, the motor rotation number is E (rpm) and the motor driving time (liquid feed time) is e (s). In this case, the ink flow rate is the second flow rate and the target pressure is P1.

When the calculated environmental historical index is not less than the third environmental historical index K3, the motor rotation number is F (rpm)→E (rpm) and the motor driving time (liquid feed time) is f1 (s)→f2 (s). In this case, the ink flow rate is the third flow rate the second flow rate and the target pressure is P2→P1.

Here, the motor rotation numbers satisfy a relationship of D (rpm)>E (rpm)>F (rpm). Further, the motor driving times satisfy a relationship of d (s)>e (s)>f (s). The ink flow rates satisfy, as mentioned above, a relationship of the first flow rate>the second flow rate>the third flow rate. The target pressures satisfy a relationship of P1>P2.

The purge operation in the inkjet recording apparatus 1A according to the second embodiment will be described below with reference to FIG. 10. FIG. 10 is a flowchart that illustrates the purge operation in the inkjet recording apparatus 1A according to the second embodiment.

Figure 10:
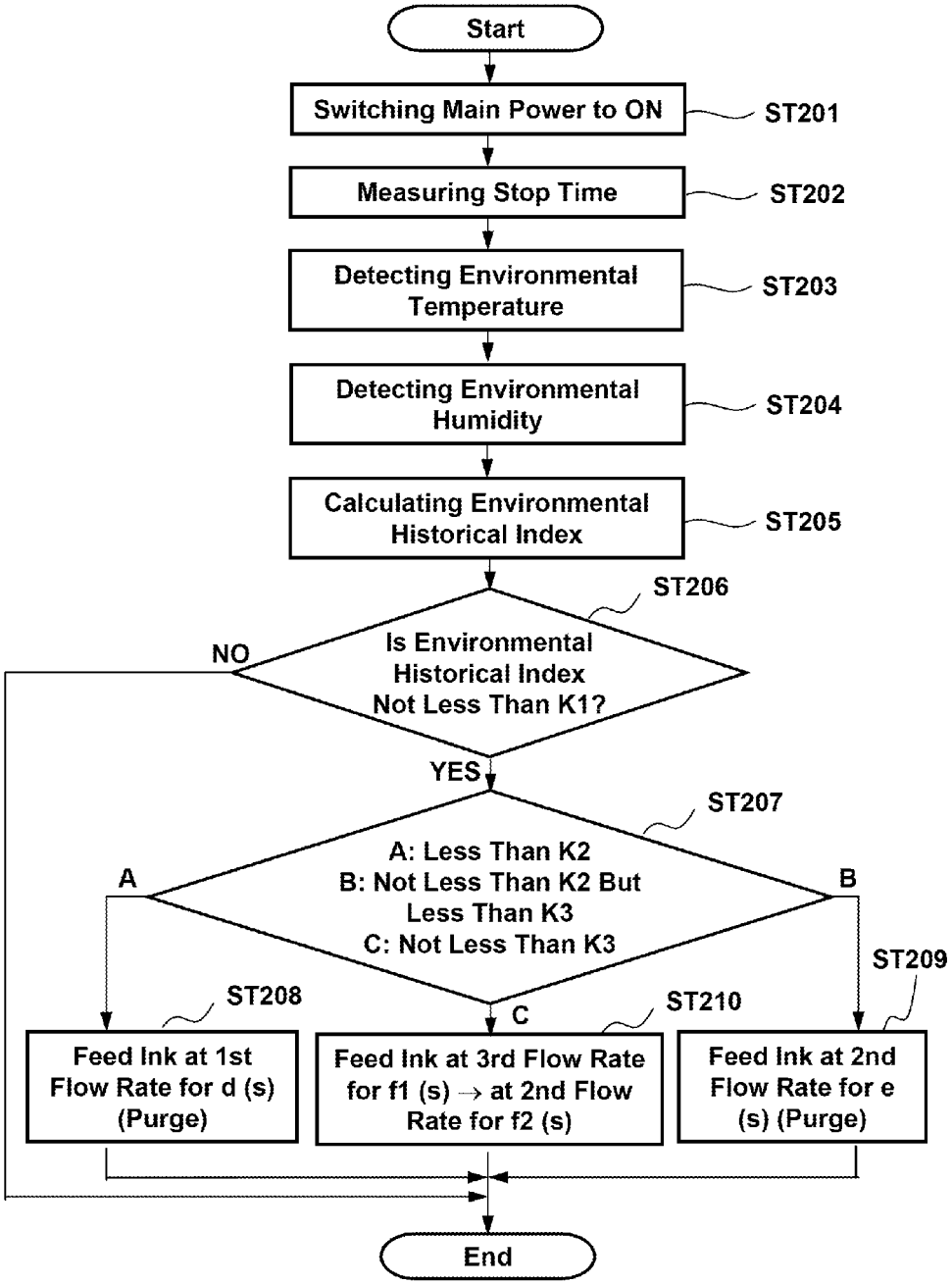
FIG. 10 is a flowchart to explain a purge operation in the inkjet recording apparatus according to the second embodiment.

As illustrated in FIG. 10, in step ST201, a user switches over the main power supply unit 330 from the off-state to the on-state. With the power-on, the main power supply unit 330 comes into a state capable of supplying electric power to the various operation units.

In step ST202, the purge timing management unit 401 instructs the time detection unit 403 to measure a time lapsed from the stopping of the ink feed to the recording head 22. Then, the time detection unit 403 measures the time lapsed from the stopping of the ink feed to the recording head 22.

In step ST203, the environmental temperature detecting unit 411 may detect an environmental temperature.

In step ST204, the environmental humidity detecting unit 412 may detect an environmental humidity.

In step ST205, the environmental historical index calculation unit 413 may calculate an environmental historical index based on a stop time value, an environmental temperature value, and an environmental humidity value.

In step ST206, the environmental historical index determination unit 414 may determine whether the calculated environmental historical index is not less than the first environmental historical index K1.

If the environmental historical index determination unit 414 may determine that the calculated environmental historical index is less than the first environmental historical index K1 (NO in ST206), the CPU 400A brings the process to an end. In this case, the purge operation is not executed.

If the environmental historical index determination unit 414 may determine that the calculated environmental historical index is not less than the first environmental historical index K1 (YES in ST206), the CPU 400A advances the process to step ST207.

In step ST207, the environmental historical index determination unit 414 may determine whether the calculated environmental historical index is not less than the second environmental historical index K2 or not less than the third environmental historical index K3. Stated another way, the environmental historical index determination unit 414 may determine whether the calculated environmental historical index is not less than a first environmental historical index K1 but less than the second environmental historical index K2 (A), or not less than the second environmental historical index K2 but less than the third environmental historical index K3 (B), or not less than the third environmental historical index K3 (C).

If the environmental historical index determination unit 414 may determine that the calculated environmental historical index is not less than the first environmental historical index K1 but less than the second environmental historical index K2 (A in ST207), the CPU 400A advances the process to step ST208.

In step ST208, the liquid feed control unit 280A controls the pump mechanism 24 (motor 278) such that the ink is fed to the recording head 22 at the first flow rate for d seconds.

If the environmental historical index determination unit 414 determines that the calculated environmental historical index is not less than the second environmental historical index K2 but less than the third environmental historical index K3 (B in ST207), the CPU 400A advances the process to step ST209.

In step ST209, the liquid feed control unit 280A controls the pump mechanism 24 (motor 278) such that the ink is fed to the recording head 22 at the second flow rate for e seconds.

If the environmental historical index determination unit 414 determines that the calculated environmental historical index is not less than the third environmental historical index K3 (C in ST207), the CPU 400A advances the process to step ST210.

In step ST210, the liquid feed control unit 280A controls the pump mechanism 24 (motor 278) such that the ink is fed to the recording head 22 at the third flow rate for f1 seconds and then fed to the recording head 22 at the second flow rate for f2 seconds.

In the image forming apparatus described above with reference to the flowchart illustrated in FIG. 10, it is determined, for example, that the calculated environmental historical index falls within which one of four value ranges, i.e., a range less than the first environmental historical index, a range not less than the first environmental historical index but less than the second environmental historical index, a range not less than the second environmental historical index but less than the third environmental historical index, and a range not less than the third environmental historical index. However, when finer control is to be performed, the number of value ranges in which different predetermined flow rates are set depending on values of the environmental historical index, respectively, may be further increased.

For example, a fourth environmental historical index K4 larger than the third environmental historical index K3 may be further set in the above-described image forming apparatus. When the environmental historical index is not less than the fourth environmental historical index K4, this implies that the ink viscosity is more likely increased to a level higher than that when the environmental historical index is less than the four environmental historical index K4. In such a case, therefore, the ink may be fed at the second flow rate after the preliminary purge has been executed by feeding the ink at the third flow rate for f1 second or longer. As another example, the ink may be fed at the third flow rate or higher after previously feeding the ink at a rate lower than the third flow rate. The number of value ranges in which different predetermined flow rates are set depending on values of the environmental historical index, respectively, may be further increased in addition to the fourth environmental historical index K4. Conversely, the configuration of the value ranges may be simplified by setting the number of value ranges to two, for example.

As with the inkjet recording apparatus 1 of the first embodiment, the inkjet recording apparatus 1A of the second embodiment has the advantageous effect that the ink feed to the head unit can be controlled in coping with change of the ink viscosity depending on temperature and humidity and with a rise of the ink viscosity due to evaporation.

Further, in the inkjet recording apparatus 1A of the second embodiment, the flow rate of the ink fed to the recording head 22 is modified in accordance with the environmental historical index that is calculated from the time during which the ink is not fed to the recording head 22 (i.e., the stop time), the environmental temperature, and the environmental humidity.

Accordingly, the inkjet recording apparatus 1A may control the ink feed to the head unit in coping with the change of the ink viscosity depending on environmental conditions.

While the second embodiment has been described above, by way of example, in connection with the case where the environmental historical index is calculated based on the environmental temperature value and the environmental humidity value, the environmental historical index may be calculated based on one of the environmental temperature value and the environmental humidity value. For example, the environmental historical index may be calculated based on the environmental temperature value. Alternatively, the environmental historical index may be calculated from the environmental humidity value.

While the second embodiment has been described above, by way of example, in connection with the case where the environmental historical index is calculated based on the product of the partial value of the detected environmental temperature, which value corresponds to a part exceeding above the predetermined temperature, and the measured stop time value, and/or the product of the partial value of the detected environmental humidity, which value corresponds to a part exceeding below the predetermined humidity, and the measured stop time value, the environmental historical index may be calculated as follows, for example, from the viewpoint of the relationship of temperature and humidity versus evaporation rate.

As a result of studying the relationship of temperature and humidity versus evaporation rate, it has been found that there is a certain relationship described below. The environmental historical index can be calculated on the basis of the certain relationship.

FIG. 11 is a table representing the relationship of temperature and humidity versus evaporation rate. As illustrated in FIG. 11, an evaporation rate L (kg/h) may be calculated from the following formula (1) on condition that the temperature is set to four values, i.e., 10° C., 20° C., 30° C. and 40° C., and the humidity is set to five values, i.e., 20% Rh, 40% Rh, 60% Rh, 80% Rh and 100% Rh:

$$L=C(Pw-Pa)A \tag{1}$$

L (kg/h): amount of water evaporated per unit time (i.e., evaporation rate)

C: evaporation coefficient, 0.0152v+0.0178 v (m/s): air velocity on water surface

Pw: saturated water vapor pressure of air at temperature that is equal to water temperature Pa: saturated water vapor pressure of air A ($m^2$): area of water surface A saturated water vapor pressure E(t) (hPa) at t (° C.) is calculated from the following formula (2):

$$E(t)=6.11\times10^{7.5t/(t+237.3)} \tag{2}$$

The air velocity on the water surface is given as v=1.0 (m/s), and the area of the water surface is given as A=1.0 $m^2$. Pa is the product of Pw and the environmental humidity.

Figure 12:
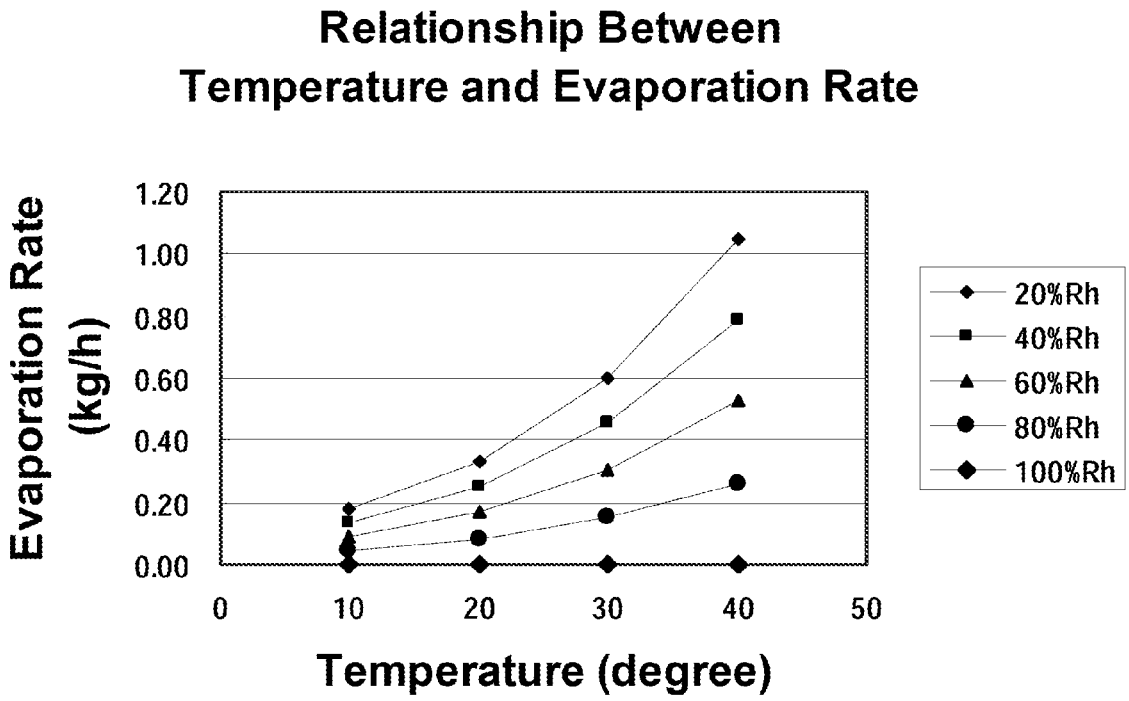
FIG. 12 is a graph representing the relationship between temperature and evaporation rate.
Figure 13:
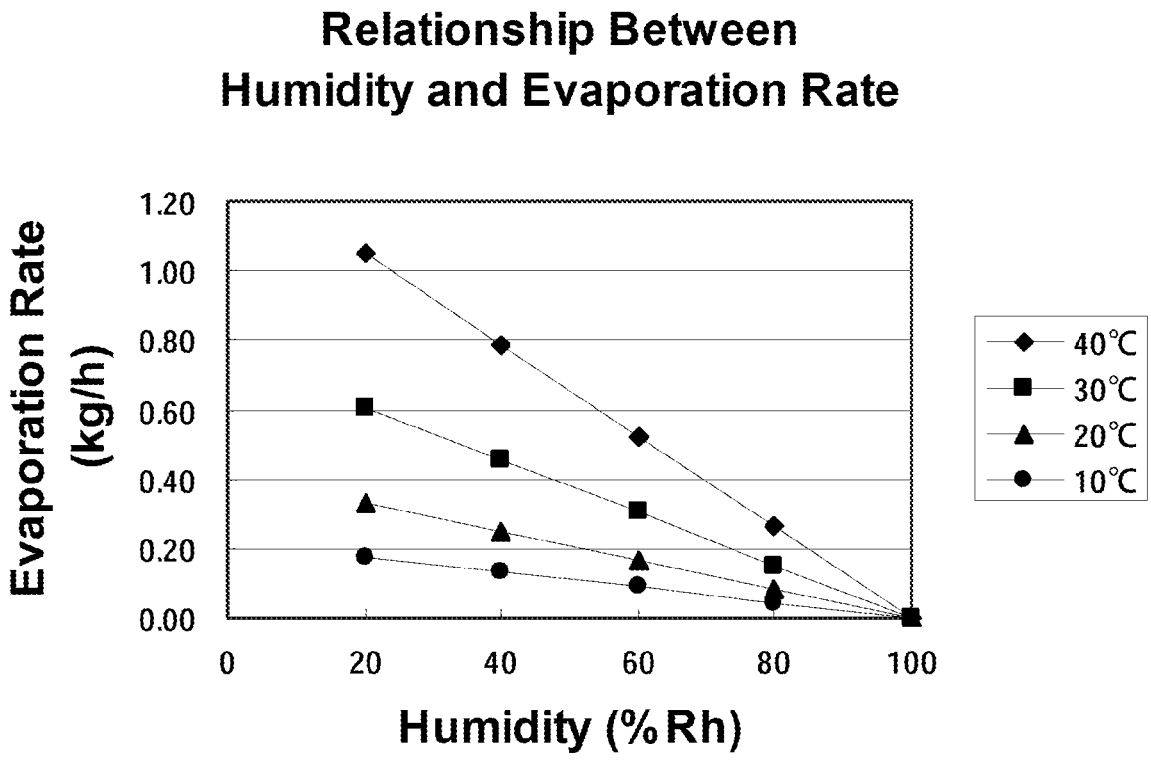
FIG. 13 is a graph representing the relationship between humidity and evaporation rate.

FIG. 12 is a graph representing the relationship between temperature and evaporation rate. FIG. 13 is a graph representing the relationship between humidity and evaporation rate. FIG. 12 represents change of the evaporation rate with respect the temperature for each value of the humidity when the humidity is held constant at 20% Rh, 40% Rh, 60% Rh, 80% Rh and 100% Rh, as illustrated in FIG. 11. FIG. 13 represents change of the evaporation rate with respect the humidity for each value of the temperature when the temperature is held constant at 10° C., 20° C., 30° C. and 40° C., as illustrated in FIG. 11. As shown in FIG. 12, when the humidity is held constant, the evaporation rate increases as the temperature rises. On the other hand, as shown in FIG. 13, when the temperature is held constant, the evaporation rate decreases as the humidity rises. In consideration of such a relationship, the environmental historical index may be calculated, for example, based on the product of the temperature (environmental temperature value) and the stop time and/or the product of a reciprocal value of the humidity (environmental humidity value) and the stop time.

Moreover, as illustrated in FIG. 12, when the environmental humidity is held constant, the evaporation rate increases exponentially as the temperature rises. Accordingly, a value of the product of a value based on power of a value of the temperature and the stop time may be used as a value corresponding to the temperature. From the graph of FIG. 12, a relational expression between temperature and evaporation rate can be represented with quadratic approximation, for example. A value calculated by using such a quadratic relational expression may be used as a value corresponding to the temperature. In that case, the environmental historical index may be calculated based on the product of a value obtained from a quadratic value of the temperature (e.g., a square value of the temperature) and the stop time, and the product of a reciprocal value of the humidity (environmental humidity value) and the stop time. Alternatively, a relational expression may be determined with exponential approximation from the graph of FIG. 12, and the environmental historical index may be calculated from that relational expression. In a more simplified manner, a relational expression may be determined with linear approximation.

For example, the graph in FIG. 12 at the humidity of 20% can be expressed by the evaporation rate L (kg/h)=$0.0007\times t^2+0.1761$ with quadratic approximation. Further, that graph can be expressed by $L=0.0985e^{0.0597t}$ with exponential approximation and by $L=0.029\times t-0.1838$ with linear approximation. Change of the evaporation rate corresponding to temperature change may be used to calculate the environmental historical index by employing one of those relational expressions.

As illustrated in FIG. 12, at a lower humidity, the evaporation rate varies to a larger extent with respect to temperature change. For example, when the humidity is 20% Rh, the evaporation rate varies to a larger extent with respect to temperature change than when the humidity is 40, 60 and 80% Rh. In view of such a tendency, when the environmental historical index is calculated by using the relational expression between temperature and evaporation rate, the calculation may be performed by using the relational expression under condition of a relatively low humidity. In FIG. 12, for example, the relational expression under condition of the humidity being at 20% Rh may be used. Using the relational expression under condition of a relatively low humidity is advantageous in that the purge can be more reliably executed, and that breakage and other damages of the constituent members of the ink flow paths and the pump mechanism can be suppressed.

Moreover, the environmental historical index may be calculated, for example, based on the product of a value corresponding to temperature change and the stop time value, and the product of a reciprocal value of a value corresponding to humidity change and the stop time. As still another example, the environmental historical index may be calculated based on the product of a value obtained by subtracting a predetermined temperature from the detected temperature and the stop time, and the product of a reciprocal value of a value obtained by subtracting the detected humidity from a predetermined humidity and the stop time. In this case, the sum of the two products may be used as the environmental historical index. Further, the product of those two products may be used as the environmental historical index. Alternatively, the environmental historical index may be calculated based on one of those two products. And yet alternatively, the calculation of the environmental historical index may be performed using the values which are obtained by multiplying any weighting coefficients by at least one of those two products as necessary.

By calculating the environmental historical index from the viewpoint of the evaporation rate as described above, the flow rate may be controlled in consideration of the influences of change of temperature and/or humidity upon the evaporation rate.

While the embodiments of this disclosure have been described above, the present invention can be practiced in various modes without being limited to the foregoing embodiments.

The foregoing embodiments have been described in connection with the case where the image forming apparatus is a color ink-jet recording apparatus (printer), but the present invention is not limited to that case. The image forming apparatus (inkjet recording apparatus) may be, for example, a black and white printer, a black and white copier, a color copier, a facsimile machine, or a multifunction peripheral having multiple functions in one machine.

Further, the recording medium is not limited to the sheet of paper T, and it may be, for example, a film sheet.

While the liquid feed control unit manages the motor in terms of time (s), a management method is not limited to the above-described one. The liquid feed control unit may manage the motor in terms of, e.g., the number of pulses.

In addition, the first flow rate, the second flow rate, and the third flow rate may be set depending on a maximum pressure and flow-path resistance, which are allowed in the inkjet recording apparatus 1.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent apparatuses and methods within the scope of the disclosure, in addition to those enumerated herein, will be apparent to those skilled in the art from the foregoing descriptions. Such modifications and variations are intended to fall within the scope of the appended claims. With respect to any or all of the ladder diagrams and flow charts in the drawings and as discussed herein, each block and/or communication may represent a process of information and/or a transmission of information in accordance with example embodiments and alternative embodiments may be included within the scope of such example embodiments. Further, more or fewer blocks and/or functions may be used with any of the ladder diagrams and flow charts discussed herein, and these ladder diagrams and flow charts may be combined with one another, in part or in whole.

The invention claimed is:

1. An image forming apparatus comprising:

an ink tank configured to contain ink;

a head unit having a nozzle configured to eject the ink;

a liquid feed path configured to feed the ink contained in the ink tank to the head unit;

a liquid feed unit configured to feed the ink contained in the ink tank to the head unit through the liquid feed path, wherein the liquid feed unit is configured to:

execute a main purge of feeding the ink to the head unit at a predetermined flow rate; and execute a preliminary purge of feeding the ink to the head unit at a flow rate not higher than the predetermined flow rate, wherein the preliminary purge is executed prior to the main purge; and a liquid-feed status detection unit configured to detect a status of the ink fed to the head unit;

a time counting unit configured to measure, based on a detection result in the liquid-feed status detection unit, a stop time, wherein the stop time is determined by calculating a duration of time for which the ink was stopped from being fed to the head unit;

an ink temperature detection unit configured to detect an ink temperature of the ink supplied to the head unit;

a first liquid feed control unit configured to:

instruct the liquid feed unit to execute the preliminary purge, wherein the first liquid feed control unit is configured to instruct the liquid feed unit to execute the preliminary purge when the stop time is not shorter than a first time, and wherein the stop time is measured by the time counting unit; and instruct the liquid feed unit not to execute the preliminary purge when the stop time is shorter than the first time; and a second liquid feed control unit configured to instruct the liquid feed unit to execute the main purge, wherein the second liquid feed control unit is configured to set the predetermined flow rate based on both the stop time measured by the time counting unit and the ink temperature detected by the ink temperature detection unit.

2. The image forming apparatus of claim 1, wherein the liquid feed unit includes:

a syringe portion;

a plunger portion configured to be movably fitted in the syringe portion; and a moving mechanism configured to move the plunger portion.

3. The image forming apparatus of claim 1, further comprising:

a time determination unit configured to determine that the stop time comprises at least one of:

a first time zone, wherein the first time zone is not shorter than the first time;

a second time zone, wherein the second time zone is not shorter than a second time but shorter than the first time, and wherein the second time is shorter than the first time; and a third time zone, wherein the third time zone is shorter than the second time; and a temperature determination unit configured to determine that the ink temperature detected by the ink temperature detection unit comprises at least one of:

a first temperature zone, wherein the first temperature zone is not lower than a first temperature;

a second temperature zone, wherein the second temperature zone is not lower than a second temperature but lower than the first temperature, and wherein the second temperature is lower than the first temperature; and a third temperature zone, wherein the third temperature zone is lower than the second temperature; and wherein the second liquid feed control unit is configured to:

set the predetermined flow rate to be a predetermined flow rate corresponding to the first temperature zone, a predetermined flow rate corresponding to the second temperature zone, and a predetermined flow rate corresponding to the third temperature zone; and set the predetermined flow rate in each of the time zones in a manner so as to ensure the predetermined flow rate corresponding to the first temperature zone is not lower than the predetermined flow rate corresponding to the third temperature zone.

4. The image forming apparatus of claim 3, wherein the first liquid feed control unit is configured to set a flow volume corresponding to the first temperature zone, set a flow volume corresponding to the second temperature zone, and set a flow volume corresponding to the third temperature zone during the preliminary purge to a same flow volume.

5. The image forming apparatus of claim 3, further comprising:

an operation unit;

a main power supply unit configured to switch to an on-state, when electric power is supplied to the operation unit, and to an off-state when electric power is not supplied to the operation unit; and a purge timing management unit configured to when the main power supply unit switches from the off-state to the on-state, control the time determination unit to obtain time measurement information, wherein the time measurement information includes a stop time value.

6. The image forming apparatus of claim 3, wherein the second liquid feed control unit is configured to:

when the stop time is determined to be within the first time zone by the time determination unit, set:

the predetermined flow rate to a first flow rate when the ink temperature is determined to be within the first temperature zone by the temperature determination unit;

the predetermined flow rate to be not lower than a second flow rate, wherein the second flow rate is lower than the first flow rate, when the ink temperature is determined to be within the second temperature zone by the temperature determination unit; and the predetermined flow rate to the second flow rate when the ink temperature is determined to be within the third temperature zone by the temperature determination unit; and when the stop time is determined to be within the second time zone by the time determination unit, set:

the predetermined flow rate to the second flow rate when the ink temperature is determined to be within the first temperature zone by the temperature determination unit;

the predetermined flow rate to be not lower than a third flow rate, wherein the third flow rate is lower than the second flow rate, when the ink temperature is determined to be within the second temperature zone by the temperature determination unit; and the predetermined flow rate to the third flow rate when the ink temperature is determined to be within the third temperature zone by the temperature determination unit; and when the stop time is determined to be within the third time zone by the time determination unit, set:

the predetermined flow rate to the first flow rate when the ink temperature is determined to be within the first temperature zone by the temperature determination unit;

the predetermined flow rate to be not lower than the second flow rate, wherein the second flow rate is lower than the first flow rate, when the ink temperature is determined to be within the second temperature zone by the temperature determination unit; and the predetermined flow rate to the second flow rate when the ink temperature is determined to be within the third temperature zone by the temperature determination unit.

7. The image forming apparatus of claim 6, wherein the first liquid feed control unit is configured to instruct the liquid feed unit to execute the preliminary purge at the third flow rate.

8. The image forming apparatus of claim 6, wherein the second liquid feed control unit is configured to:

set a flow volume corresponding to the flow rate; and set the flow volume such that a flow volume corresponding to the first flow rate is not less than a flow volume corresponding to the second flow rate.

9. The image forming apparatus of claim 6, wherein the second liquid feed control unit is configured to:

set a flow volume corresponding to the flow rate; and set a flow volume corresponding to the first flow rate, a flow volume corresponding to the second flow rate, and a flow volume corresponding to the third flow rate to a same flow volume.

10. A control method for an image forming apparatus comprising:

detecting a liquid feed status corresponding to ink fed to a head unit;

measuring, based on a detection result of the liquid feed status, a stop time, wherein the stop time is determined by calculating a duration of time for which the ink was stopped from being fed to the head unit;

detecting a temperature of the ink fed to the head unit;

setting a predetermined flow rate based on the stop time and the ink temperature;

executing a main purge of feeding the ink to the head unit at the predetermined flow rate;

when the stop time is not shorter than a first time, executing the main purge after executing a preliminary purge of feeding the ink to the head unit at a flow rate, wherein the flow rate is not higher than the predetermined flow rate, prior to the main purge of feeding the ink to the head unit at the predetermined flow rate; and when the measured stop time is shorter than the first time, executing the main purge without executing the preliminary purge.

* * * * *